US010377155B2

(12) United States Patent
Otsuka et al.

(10) Patent No.: US 10,377,155 B2
(45) Date of Patent: Aug. 13, 2019

(54) DETECTION DEVICE AND RECORDING APPARATUS

(71) Applicant: SEIKO EPSON CORPORATION, Tokyo (JP)

(72) Inventors: Shuji Otsuka, Shiojiri (JP); Seiichi Taniguchi, Asahi-Mura (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 15/691,417

(22) Filed: Aug. 30, 2017

(65) Prior Publication Data

US 2018/0056678 A1 Mar. 1, 2018

(30) Foreign Application Priority Data

Aug. 31, 2016 (JP) ..... 2016-168966

(51) Int. Cl.
*B65H 7/02* (2006.01)
*B41J 13/00* (2006.01)
*B41J 11/00* (2006.01)

(52) U.S. Cl.
CPC ..... *B41J 13/0009* (2013.01); *B41J 11/006* (2013.01); *B41J 11/0095* (2013.01)

(58) Field of Classification Search
USPC ..... 271/265.01; 73/800
See application file for complete search history.

(56) References Cited

U.S. PATENT DOCUMENTS

2008/0150226 A1* 6/2008 Kawasaki ..... B65H 7/02 271/265.01

FOREIGN PATENT DOCUMENTS

| | | | |
|---|---|---|---|
| JP | 58-187739 | U | 12/1983 |
| JP | 09-240011 | A | 9/1997 |
| JP | 2001-302021 | A | 10/2001 |
| JP | 2013-086925 | A | 5/2013 |
| JP | 2015-186852 | A | 10/2015 |

* cited by examiner

*Primary Examiner* — Lam S Nguyen
(74) *Attorney, Agent, or Firm* — Foley & Lardner LLP

(57) ABSTRACT

Disclosed is a recording apparatus including a recording head that performs recording with respect to a medium at a prescribed distance, a contact section that is capable of being in contact with the medium, a carriage that changes a relative location between the medium and the contact section, and an ultrasonic sensor that is capable of sensing an ultrasonic wave which is generated in a case where the medium is in contact with the contact section. The carriage changes the relative location such that a relative velocity between the medium and the contact section is over a prescribed value (transport velocity of the medium), and the ultrasonic sensor is capable of detecting a state of the medium by sensing the ultrasonic wave.

13 Claims, 14 Drawing Sheets

DETECTION DEVICE AND RECORDING APPARATUS

BACKGROUND

1. Technical Field

The present invention relates to a detection device and a recording apparatus on which the detection device is mounted.

2. Related Art

In the related art, a recording apparatus is known which transports a medium, such as paper, and records an image with respect to the medium by discharging ink from a recording head.

For example, a recording apparatus (image recording apparatus) disclosed in JP-A-2001-302021 includes a recording head that discharges ink to a medium, a transport system that transports the medium, a sound detection unit that detects sound generated in a case of jamming of the medium and converts the sound into an electrical signal, and an amplification unit that amplifies the electrical signal, and senses the jamming of the medium (clogging of the medium) using a frequency component which is included in the electrical signal amplified by the amplification unit. Furthermore, in a case where the jamming of the medium occurs, a recording operation of the recording apparatus is stopped.

However, since the recording apparatus disclosed in JP-A-2001-302021 senses the jamming of the medium after the jamming of the medium occurs, there is a problem in that it is difficult to prevent the jamming of the medium and bad influence (for example, failure in the recording head due to contact with the medium) due to the jamming of the medium.

SUMMARY

The invention can be realized in the following aspects or application examples.

Application Example 1

In a detection device according to this application example, there is provided a detection device that is capable of detecting a state of a medium, the device including: a contact section that is capable of being in contact with the medium; a location change section that changes a relative location between the medium and the contact section; and an elastic wave sensing section that is capable of sensing an elastic wave which is generated in a case where the medium is in contact with the contact section, in which the location change section changes the relative location such that a relative velocity between the medium and the contact section is equal to or larger than a prescribed value, and in which the elastic wave sensing section is capable of detecting the state of the medium by sensing the elastic wave.

The location change section that changes the relative location between the medium and the contact section changes the relative location between the medium and the contact section such that the relative velocity between the medium and the contact section becomes equal to or larger than the prescribed value. Therefore, compared to a case where the relative velocity between the medium and the contact section is less than the prescribed value, it is possible to increase amplitude of the elastic wave which is generated in a case where the medium is in contact with the contact section.

For example, even in a case where the medium is slightly in contact with the contact section, the amplitude of the elastic wave which is generated in a case where the medium is in contact with the contact section is increased. Therefore, the elastic wave sensing section easily detects the elastic wave. In a case where the elastic wave sensing section detects the elastic wave, the detection device is capable of catching contact that is between the medium and the contact section.

Application Example 2

In the detection device according to the application example, it is preferable that the elastic wave be an ultrasonic wave.

In a case where the ultrasonic wave is detected in a case where the medium is in contact with the contact section, for example, it is possible to detect the contact between the medium and the contact section without being influenced by sound in an audible range having a frequency which is lower than the ultrasonic wave.

Application Example 3

In the recording apparatus according to the application example, there is provided a recording apparatus including: a recording section that performs recording on a medium at a prescribed distance; a contact section that is capable of being in contact with the medium; a location change section that changes a relative location between the medium and the contact section; and an elastic wave sensing section that is capable of sensing an elastic wave which is generated in a case where the medium is in contact with the contact section, in which the location change section changes the relative location such that a relative velocity between the medium and the contact section is equal to or larger than a prescribed value, and in which the elastic wave sensing section is capable of detecting the state of the medium by sensing the elastic wave.

The location change section that changes the relative location between the medium and the contact section changes the relative location between the medium and the contact section such that the relative velocity between the medium and the contact section becomes equal to or larger than the prescribed value. Therefore, compared to a case where the relative velocity between the medium and the contact section is less than the prescribed value, it is possible to increase amplitude of the elastic wave which is generated in a case where the medium is in contact with the contact section.

For example, even in a case where the medium is slightly in contact with the contact section, the amplitude of the elastic wave which is generated in a case where the medium is in contact with the contact section is increased. Therefore, the elastic wave sensing section easily detects the elastic wave. In a case where the elastic wave sensing section detects the elastic wave, the detection device is capable of catching contact that is between the medium and the contact section. In other words, the recording section is capable of detecting a state of the medium on which recording is performed.

Application Example 4

In the recording apparatus according to the application example, it is preferable that the contact section be disposed in a location which is less than the prescribed distance with respect to the medium.

The contact section is disposed in the location in which is less than the prescribed distance with respect to the medium. That is, the contact section is disposed such that the distance between the contact section and the medium is less than, for example, the distance (at a prescribed distance) between the medium and an object which is not desired to be in contact with the medium. Therefore, it is possible to detect a possibility that the object, which is not desired to be in contact with the medium, is in contact with the medium.

In a case where it is not desired to cause the recording section to be in contact with the medium, it is possible to detect a sign of floating or the like of the medium, which is in contact with the recording section, by detecting the elastic wave which is generated due to the contact between the medium and the contact section. Furthermore, it is possible to prevent the contact between the recording section and the medium and bad influence due to the contact between the recording section and the medium (jamming of the medium, failure in the recording section, or the like) by performing a countermeasure to improve the sign.

Application Example 5

In the recording apparatus according to the application example, it is preferable that the location change section move the contact section to face the medium.

In a case where the location change section moves the contact section to face the medium, it is easy to detect a state of the medium.

Application Example 6

In the recording apparatus according to the application example, it is preferable that the recording section be disposed to face over the whole medium in a direction that crosses a direction in which the location change section moves the contact section.

The recording section is capable of recording an image or the like over the whole medium in the direction that crosses the direction in which the location change section moves the contact section, and thus it is possible to rapidly perform recording with respect to the medium, compared to, for example, a case where recording of the image or the like is performed on a part of the medium in the direction that crosses the direction in which the location change section moves the contact section.

Application Example 7

In the recording apparatus according to the application example, it is preferable that the recording apparatus further include a transport section that transports the medium in a transport direction, and the prescribed value of the relative velocity be a transport velocity of the medium.

The relative velocity between the medium and the contact section is more rapid than the transport velocity (prescribed value) of the medium. Therefore, compared to a case where the relative velocity between the medium and the contact section is less than the transport velocity (prescribed value) of the medium, the medium is strongly in contact with the contact section in a case where the medium is in contact with the contact section, and thus it is possible to increase amplitude of the elastic wave which is generated in a case where the medium is in contact with the contact section.

Application Example 8

In the recording apparatus according to the application example, it is preferable that the contact section be disposed on an upstream side rather than the recording section in the transport direction, and be capable of changing a location in a direction which is different from the transport direction by the location change section.

In a case where the contact section is disposed on the upstream side rather than the recording section in a transport direction of the medium, the medium is in contact with the contact section previous to the recording section in a case where floating of the medium is generated. That is, before the contact between the medium and the recording section is generated, the medium is in contact with the contact section. Therefore, it is possible to detect risk in which the medium is in contact with the recording section by detecting the contact between the medium and the contact section. Therefore, it is possible to prevent the contact between the medium and the recording section and the bad influence due to the contact between the medium and the recording section (jamming of the medium, failure in the recording section, or the like) by detecting the risk in which the medium is in contact with the recording section, and solving, for example, a cause in which the medium is in contact with the contact section in advance before the medium is in contact with the recording section.

Furthermore, in a case where the location of the contact section is changed in a direction which is different from the transport direction of the medium, it is possible to cause the relative velocity to be rapid compared to a case where the location of the contact section is not changed in the direction which is different from the transport direction of the medium, and it is possible to increase the amplitude of the elastic wave which is generated in a case where the medium is in contact with the contact section by causing the medium to be strongly in contact with the contact section in a case where the medium is in contact with the contact section.

Application Example 9

In the recording apparatus according to the application example, it is preferable that the location change section rotate the contact section in a direction which is opposite to the transport direction.

In a case where the location change section rotates the contact section in the direction which is opposite to the transport direction of the medium, it is possible to cause the relative velocity to be rapid compared to a case where the location change section does not cause the contact section to be rotated in the direction which is opposite to the transport direction of the medium, and it is possible to increase the amplitude of the elastic wave which is generated in the case where the medium is in contact with the contact section by causing the medium to be strongly in contact with the contact section in a case where the medium is in contact with the contact section.

Application Example 10

In the recording apparatus according to the application example, it is preferable that the recording section be disposed to face over the whole medium in a direction which crosses the transport direction.

The recording section is capable of performing recording over the whole medium in the direction which crosses the transport direction of the medium, and thus it is possible to rapidly perform recording on the medium, compared to a case where, for example, the recording section performs recording on a part of the medium in the direction that crosses the transport direction of the medium.

Application Example 11

In the recording apparatus according to the application example, it is preferable that the location change section include the recording section and the contact section which are mounted thereon and be capable of moving to face the medium in a direction which crosses the transport direction.

Since the recording section and the contact section are capable of moving together by the location change section, it is possible to simplify a component (location change section) which moves the recording section and the contact section, compared to a case where the recording section and the contact section are separately capable of moving.

Application Example 12

In the recording apparatus according to the application example, it is preferable that the elastic wave be an ultrasonic wave.

In a case where the ultrasonic wave is detected in a case where the medium is in contact with the contact section, it is possible to detect the contact between the medium and the contact section without being, for example, influenced by sound in the audible range having the frequency which is lower than the ultrasonic wave.

For example, in a case where the sound in the audible range is included in operation sound which is generated when the recording apparatus is operated, if the contact between the contact section and the medium is detected by the ultrasonic wave having a frequency higher than the sound in the audible range, influence of the sound (noise) in the audible range which is included in the operation sound of the recording apparatus is small, and thus it is easy to detect the contact between the contact section and the medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
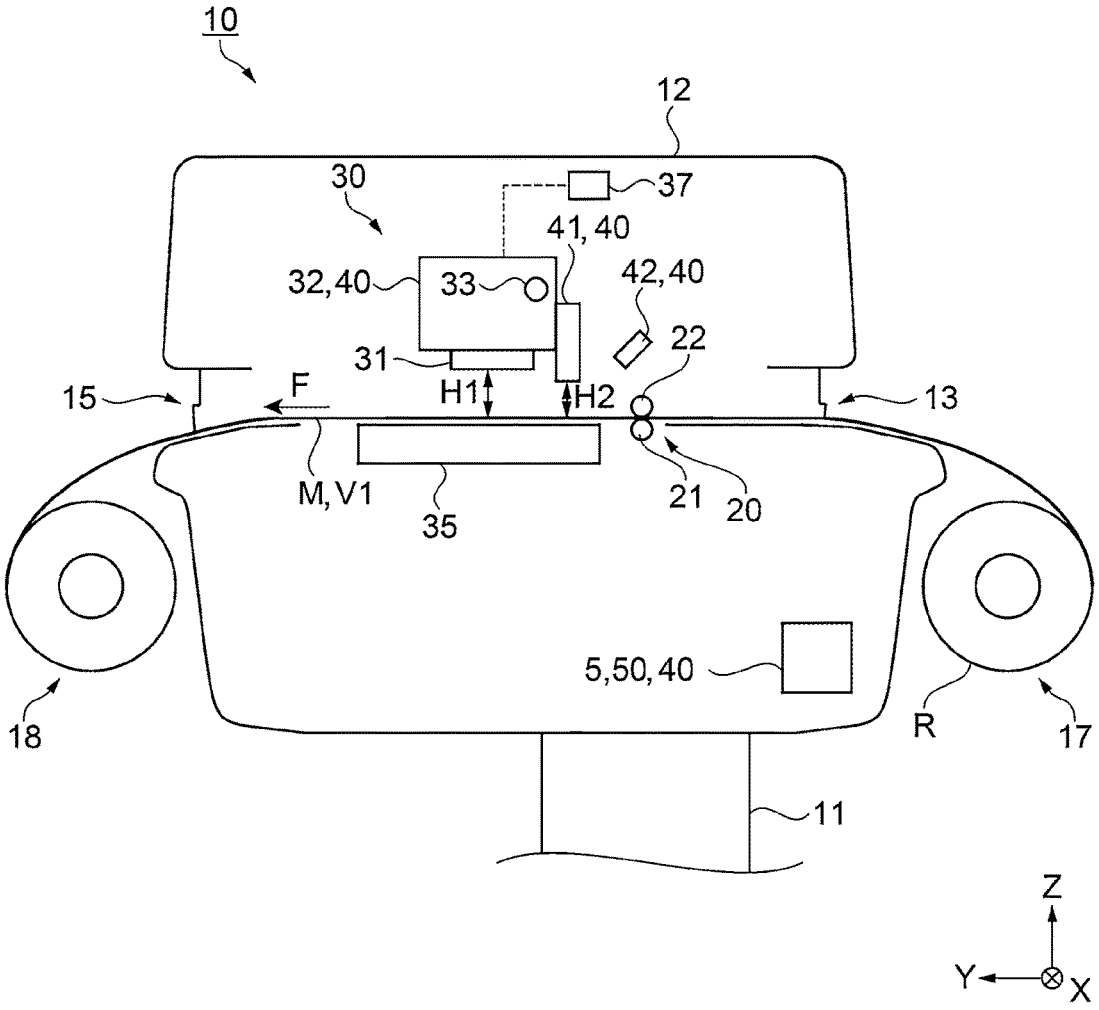
FIG. 1 is a schematic diagram illustrating an outline of a recording apparatus according to Embodiment 1.

Hereinafter, embodiments of the invention will be described with reference to the accompanying drawings. The embodiments describe aspects of the invention, do not limit the invention, and may be arbitrarily changed in the technical spirit of the invention. In addition, in each of the drawings below, each layer or each portion has a size to the extent that is recognizable on the drawing, and thus there is a case where a scale of each layer or each portion is different from a real scale.

Embodiment 1

Outline of Recording Apparatus

Figure 2:
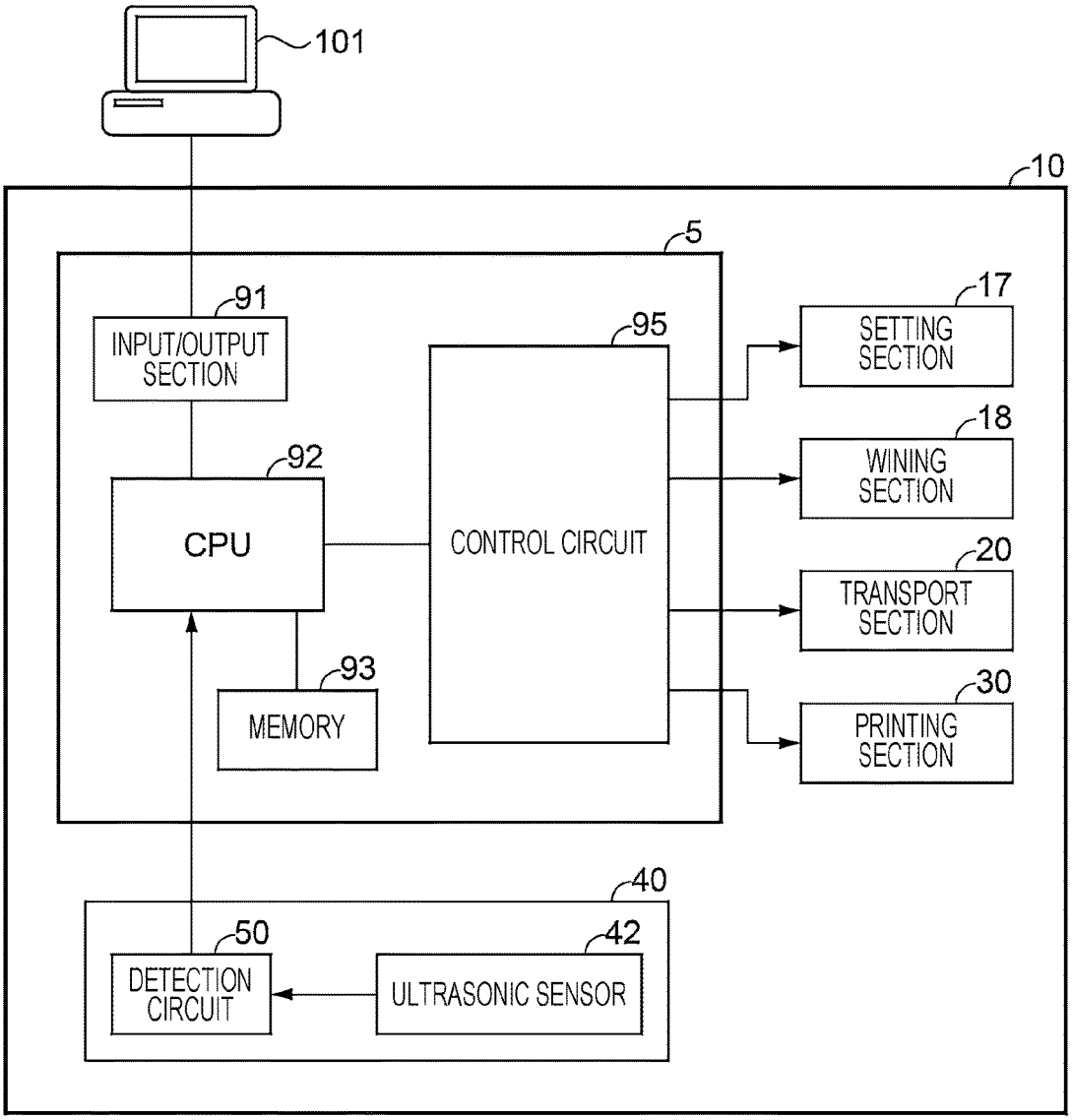
FIG. 2 is a control block diagram of the recording apparatus according to Embodiment 1.

FIG. 1 is a schematic diagram illustrating an outline of a recording apparatus according to Embodiment 1. FIG. 2 is a control block diagram of the recording apparatus according to the embodiment.

Initially, the outline of a recording apparatus 10 according to the embodiment will be described with reference to FIGS. 1 and 2.

As illustrated in FIG. 1, the recording apparatus 10 according to the embodiment is a Large Format Printer (LFP) which treats a medium M. The recording apparatus 10 includes a leg section 11, a housing section 12 that is supported by the leg section 11, and a setting section 17 and a winding section 18 that are attached to both ends of the housing section 12. It is possible to use, for example, high-quality paper, cast paper, art paper, code paper, synthetic paper, or a film which is formed of polyethylene-terephthalate (PET) or polypropylene (PP) as the medium M. Meanwhile, the medium M is not limited to the above description. In addition, it is possible to use various types of paper which have a long length or a regular size.

In description below, it is assumed that a height direction of the recording apparatus 10 is a Z direction, a direction which is orthogonal to the Z direction and which faces the winding section 18 from the setting section 17 is a Y direction, and a direction (width direction of the medium M) which is orthogonal to the Z direction and the Y direction is an X direction. In addition, it is assumed that a tip end side of an arrow which indicates a direction is a (+) direction, and a base end side thereof is a (−) direction.

The housing section 12 is provided with a transport section 20 that transports the medium M in a transport direction F, a printing section 30 that performs printing on the medium M, a control unit 5, and a detection device 40 that is capable of detecting a state of the medium M thereinside. Meanwhile, details of the detection device 40 will be described later.

The medium M is drawn from a roll body R which is stored in the setting section 17, is fed into the inside of the housing section 12 from a feeding port 13, is printed in the printing section 30, is exhausted to the outside of the housing section 12 from the exhaust port 15, and is wound in a roll shape by the winding section 18.

Meanwhile, the medium M may not be roll paper but be cut-form paper.

The transport section 20 transports the medium M in the transport direction F. Specifically, the transport section 20 is disposed on an upstream side of the transport direction F with respect to the printing section 30, includes a drive roller 21 and a follower roller 22, and transports the medium M which is fed from the setting section 17 to the printing section 30. The follower roller 22 is brought into pressure contact with the drive roller 21 through the medium M, and performs slave rotation. The drive roller 21 interposes the medium M between the drive roller 21 and the follower roller 22. In a case where the drive roller 21 is rotary driven by the drive motor (not shown in the drawing), the medium M is transported in the transport direction F.

The printing section 30 includes a recording head 31 that performs recording with respect to the medium M at a prescribed distance, a carriage 32 that maintains the recording head 31, a guide shaft 33 that supports the carriage 32, a medium support section 35 that supports the medium M, and a movement mechanism 37.

Meanwhile, the recording head 31 is an example of a "recording section".

The recording head 31 includes a plurality of nozzles (not shown in the drawing), and has a structure which is capable of discharging ink. The recording head 31 records (prints) an image on the medium M by discharging ink to the medium M. The recording head 31 is disposed at a prescribed distance (distance H1) with respect to the medium M. That is, an distance between the recording head 31 and the medium M is H1.

Meanwhile, the distance H1 between the recording head 31 and the medium M is an example of a "prescribed distance", and the recording head 31 performs recording on with respect to the medium M at the prescribed distance (distance H1).

The carriage 32 supports the recording head 31 and a contact section 41 which is a component of the detection device 40. The movement mechanism 37 is a mechanism which includes a belt (not shown in the drawing) and a drive motor (not shown in the drawing) and moves the carriage 32. The carriage 32 is supported by the guide shaft 33 and reciprocates in a direction (X direction), which is orthogonal to the transport direction F of the medium M, by the movement mechanism 37. Furthermore, the recording head 31 and the contact section 41, which are supported by the carriage 32, are also capable of moving in the direction (X direction), which is orthogonal to the transport direction F, to face the medium M together with the carriage 32.

That is, the carriage 32 is mounted with the recording head 31 and the contact section 41, and is capable of moving in a direction (direction which is different from the transport direction F) which is orthogonal to the transport direction F to face the medium M. Furthermore, the contact section 41 is capable of changing a location in a direction which is different from the transport direction F by the carriage 32.

As described above, the carriage 32 is capable of moving the recording head 31 and the contact section 41 to face the medium M, and changes a relative location between the medium M and the recording head 31 and a relative location between the medium M and the contact section 41.

The medium support section 35 supports the medium M which is transported to the printing section 30, and has an approximately rectangular-shaped surface, in which a width direction (X direction) of the medium M is a longitudinal direction, on an upper surface which faces the recording head 31. Furthermore, the medium support section 35 includes an absorption mechanism (not shown in the drawing) that forms a negative pressure and an absorption hole (not shown in the drawing), and absorbs and supports the medium M by driving the absorption mechanism. Therefore, deterioration of recording qualities due to floating of the medium M is prevented.

In the recording apparatus 10, an image is recorded on the medium M by alternatively repeating an operation in which the printing section 30 discharges ink to the medium M from the recording head 31 while causing the recording head 31 to reciprocate in the X direction and an operation in which the transport section 20 transports the medium M in the transport direction F (Y direction).

In addition, a transport velocity of the medium M is V1 in the operation in which the transport section 20 transports the medium M in the transport direction F. The transport velocity V1 of the medium M is an example of a "prescribed value of the relative velocity between the medium and the contact section.

As illustrated in FIG. 2, the control unit 5 is a control unit that controls the recording apparatus 10, and includes an input/output section 91, a CPU 92, a memory 93, a control circuit 95, and the like. The CPU 92, the memory 93, and the control circuit 95 are connected through a system bus.

The input/output section 91 transmits and receives data between a computer (external device) 101 and the recording apparatus 10. The CPU 92 is an arithmetic processing device which controls the whole recording apparatus 10. The memory 93 includes a memory element such as a RAM, a ROM, and a flash memory, stores a program which is operated by the CPU 92, and preserves necessary information such as a result of operation performed by the CPU 92.

The CPU 92 controls each of the sections of the recording apparatus 10, such as the setting section 17, the winding section 18, the transport section 20, and the printing section 30, through the control circuit 95. Although details will be described later, the detection device 40 monitors a situation of the medium M through an ultrasonic sensor 42. The CPU 92 controls each of the sections of the recording apparatus 10 based on a result of monitoring performed by the detection device 40.

Outline of Detection Device

Figure 3:
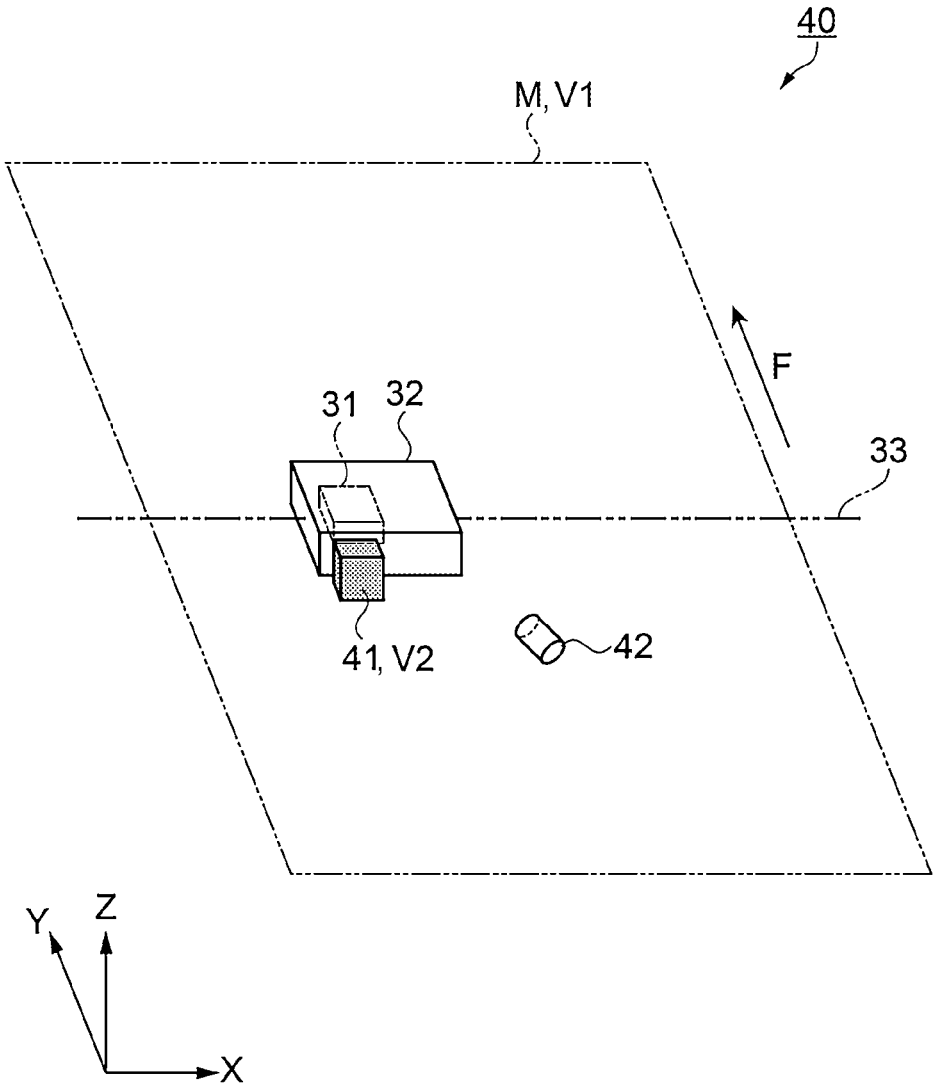
FIG. 3 is a schematic diagram illustrating an outline of a detection device.
Figure 4:
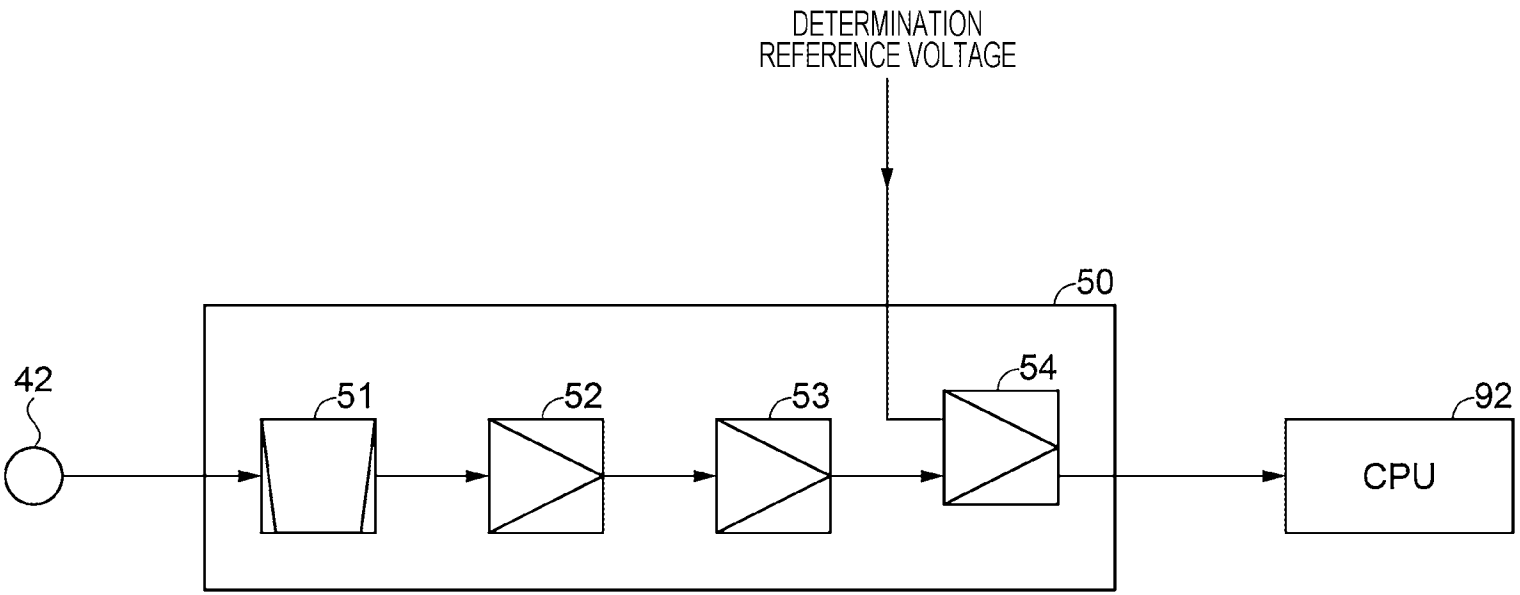
FIG. 4 is a block diagram illustrating an outline of a detection circuit.

FIG. 3 is a schematic diagram illustrating an outline of the detection device. FIG. 4 is a block diagram illustrating the outline of the detection circuit. Meanwhile, in FIG. 3, a component of the detection device 40 is illustrated by a solid line, and components other than the detection device 40 are illustrated by a two-dot chain line. Furthermore, in FIG. 3, the detection circuit 50, which is the component of the detection device 40, is not illustrated.

Subsequently, the outline of the detection device 40 will be described with reference to FIGS. 3 and 4.

As illustrated in FIG. 3, the detection device 40 includes the contact section 41 that is capable of being in contact with the medium M, the carriage 32 that changes the relative location between the medium M and the contact section 41, the ultrasonic sensor 42 that is capable of sensing an elastic wave (ultrasonic wave) which is generated in a case where the medium M is in contact with the contact section 41, and the detection circuit 50 (see FIG. 1).

Meanwhile, the carriage 32 is an example of a "location change section", and the ultrasonic sensor 42 is an example of an "elastic wave sensing section".

The contact section 41 is disposed on the upstream side with respect to the recording head 31 in the transport direction F, and is capable of changing a location in a direction which is different from the transport direction F using the carriage 32. A distance between the contact section 41 and the medium M is H2. The distance H2 between the contact section 41 and the medium M is less than the distance H1 between the recording head 31 and the medium M. In other words, the contact section 41 is disposed in a location which is less than the distance H1 (the prescribed distance) with respect to the medium M, and the distance between the contact section 41 and the medium M is the distance H2 which is less than the distance H1 between the recording head 31 and the medium M. Meanwhile, there is a case where the recording head 31 is moved in an approaching/separating direction with respect to the medium M in order to preserve a proper distance, and it is possible to adjust the distance between the contact section 41 and the medium M in accordance with the proper distance. In a case where it is possible to adjust the distance between the contact section 41 and the medium M, it is possible to maintain the distance H2 which is less than the distance H1. In addition, in a case where the distance between the contact section 41 and the medium M is fixed, the distance between the contact section 41 and the medium M is adjusted such that the distance is less than a minimum distance between the recording head 31 and the medium M.

Therefore, in a case where the medium M floats in the Z (+) direction, a floating part of the medium M is in contact with the contact section 41 earlier than the recording head 31. In other words, in a case where the medium M floats in the Z (+) direction, the contact section 41 is disposed in a location where it is possible to be in contact with the medium M earlier than the recording head 31.

It is preferable that the contact section 41 be formed of a material which hardly damages the medium M in a case of being in contact with the medium M.

For example, as a component material of the contact section 41, a resin is preferable which includes polyethylene, polypropylene, polyethylene terephthalate, vinyl chloride, polystyrene, ABS resin (copolymerization synthetic resin including acrylonitrile, butadiene, and styrene), acrylic, polyamide (nylon resin), polycarbonate, fluorocarbon resin (for example, tetrafluoroethylene), ethylene-vinyl acetate copolymer, phenol resin, bakelite, melamine, unsaturated polyester, epoxy, cellulose, or the like. Meanwhile, a material, which does not damage the medium M in a case of being in contact with the medium M, is further preferable.

In a case where the contact section 41 is in contact with the medium M, sound (ultrasonic wave) which has a higher frequency (approximately 30 to 60 kHz) than sound of an audible range (approximately 15 to 20 kHz) is generated. Meanwhile, the ultrasonic wave, which is generated in the case where the contact section 41 is in contact with the medium M, is an example of an "elastic wave".

In the embodiment, in a case where the contact section 41 is in contact with the medium M, minute irregularities are provided on a surface of the contact section 41 which is in contact with the medium M (hereinafter, referred to as a surface) such that an ultrasonic wave, which has large amplitude, (hereinafter, referred to as a large ultrasonic wave) is generated. That is, in a case where the minute irregularities are provided on the surface of the contact section 41, it is possible to generate a large ultrasonic wave in a case where the contact section 41 is in contact with the medium M, compared to a case where the surface of the contact section 41 is smooth.

For example, in a case where the surface of the contact section 41 is roughened using a file, sand paper, or the like, it is possible to provide the minute irregularities on the surface of the contact section 41. For example, it is possible to provide the minute irregularities on the surface of the contact section 41 using a blasting method which causes a polishing material to collide with the surface of the contact section 41. For example, it is possible to provide the minute irregularities on the surface of the contact section 41 by fixing minute particles to the surface of the contact section 41. For example, it is possible to provide the minute irregularities on the surface of the contact section 41 by forming the contact section 41 using foamed resin and forming minute cavities.

Furthermore, in the case where the contact section 41 is in contact with the medium M, relative velocity V2 between the medium M and the contact section 41 (hereinafter, referred to as movement velocity of the contact section 41) is set to a value which is equal to or larger than a prescribed value (the transport velocity V1 of the medium M) such that a large ultrasonic wave is emitted.

Specifically, the carriage 32 moves the contact section 41 to face the medium M, and changes the relative location between the medium M and the contact section 41. The carriage 32 changes the relative location between the medium M and the contact section 41 such that the movement velocity V2 of the contact section 41 is equal to or larger than a prescribed value (the transport velocity V1 of the medium M). As a result, since the movement velocity V2 of the contact section 41 which is supported by the carriage 32 is equal to or larger than the prescribed value (the transport velocity V1 of the medium M), the contact section 41 is strongly in contact with the medium M compared to a case where the movement velocity V2 of the contact section 41 is less than the prescribed value, and it is possible to emit a large ultrasonic wave in the case where the contact section 41 is in contact with the medium M. In the embodiment, the movement velocity V2 of the contact section 41 is scan velocity of the carriage 32, and the scan velocity of the carriage 32 is more rapid than the transport velocity V1 of the medium M.

In the recording apparatus 10, various types of sound are generated in addition to the ultrasonic wave which is emitted in the case where the contact section 41 is in contact with the medium M. For example, sound (for example, sliding sound) is emitted by operating components (the transport section 20, the printing section 30, and the like) of the recording apparatus 10.

Hereinafter, sound which is generated in the case where the contact section 41 is in contact with the medium M is referred to as contact sound between the contact section 41 and the medium M. Sound which is generated by operating the recording apparatus 10 (sound other than the contact sound between the contact section 41 and the medium M) is referred to as operation sound of the recording apparatus 10.

The contact sound between the contact section 41 and the medium M includes a large amount of sound (ultrasonic wave) in a high frequency band (approximately 30 to 60 kHz). Therefore, even in a situation in which the operation sound of the recording apparatus 10 is simultaneously generated, the ultrasonic wave is detected, and thus it is easy to capture the contact sound between the contact section 41 and the medium M. In the embodiment, a configuration is provided in which contact between the contact section 41 and the medium M is detected by monitoring (observing) the ultrasonic wave of the high frequency band (approximately 30 to 60 kHz), and contact between the medium M and the recording head 31 is previously prevented.

Details will be described below.

The ultrasonic sensor 42 is a sensor device which is capable of detecting the ultrasonic wave, and is disposed in a location where it is easy to detect the contact sound between the contact section 41 and the medium M. Specifically, the ultrasonic sensor 42 is disposed on an upstream side of the transport direction F with respect to the contact section 41, and is disposed on a Z (+) direction side with respect to the medium M. In a case where it is easy to detect the contact sound between the contact section 41 and the medium M, for example, the ultrasonic sensor 42 may be disposed on the Z (−) direction side with respect to the medium M.

In the detection device 40, the ultrasonic sensor 42 detects the contact sound (ultrasonic wave) between the contact section 41 and the medium M, and thus it is possible to detect the state of the medium M. The ultrasonic wave which is detected by the ultrasonic sensor 42 is converted into an electrical signal, and is output to the detection circuit 50.

As illustrated in FIG. 4, the detection circuit 50 includes a filter section 51, an amplifying section 52, an AC amplitude-DC voltage conversion section 53, and a voltage comparison section 54.

The filter section 51 is an analog filter that extracts a necessary frequency component and removes an unnecessary frequency component. The filter section 51 removes sound in the audible range (approximately 15 to 20 kHz) as noise, extracts the ultrasonic wave having a high frequency (approximately 30 to 60 kHz), and outputs the ultrasonic wave to the amplifying section 52 as an AC signal. That is, the filter section 51 extracts the ultrasonic wave, which is included in the contact sound between the contact section 41 and the medium M a lot, compared to the operation sound of the recording apparatus 10, and outputs the ultrasonic wave to the amplifying section 52 as the AC signal.

The amplifying section 52 amplifies the AC signal, and outputs the amplified AC signal to the AC amplitude-DC voltage conversion section 53.

The AC amplitude-DC voltage conversion section 53 converts the AC signal from the amplifying section 52 into a DC voltage, and outputs the DC voltage to the voltage comparison section 54 as a DC determination signal.

Meanwhile, the DC determination signal, which is output to the voltage comparison section 54, includes a DC determination signal corresponding to the contact sound between the contact section 41 and the medium M, and a DC determination signal corresponding to the operation sound of the recording apparatus 10. The DC determination signal corresponding to the operation sound of the recording apparatus 10 is noise which impedes detection of contact between the contact section 41 and the medium M. The DC determination signal corresponding to the operation sound of the recording apparatus 10 is stored in the memory 93 as a determination reference voltage.

Specifically, the recording apparatus 10 is operated in a state in which the contact section 41 is not in contact with the medium M, the operation sound of the recording apparatus 10 is actually measured, the DC determination signal corresponding to the operation sound of the recording apparatus 10 is acquired, and the DC determination signal corresponding to the operation sound of the recording apparatus 10 is stored in the memory 93 as the determination reference voltage.

The voltage comparison section 54 reads the determination reference voltage which is stored in the memory 93, and compares the DC determination signal with the determination reference voltage. In a case where the DC determination signal is equal to or lower than the determination reference voltage, the voltage comparison section 54 determines that the contact between the contact section 41 and the medium M does not occur, and outputs a digital signal (for example, 0 V), which indicates that the contact section 41 is not in contact with the medium M, to the CPU 92. The voltage comparison section 54 compares the DC determination signal with the determination reference voltage. In a case where the DC determination signal is higher than the determination reference voltage, the voltage comparison section 54 determines that the contact between the contact section 41 and the medium M occurs, and outputs a digital signal (for example, 1 V), which indicates that the contact section 41 is in contact with the medium M, to the CPU 92.

In other words, the voltage comparison section 54 determines occurrence/non-occurrence of the contact between the contact section 41 and the medium M based on difference between the DC determination signal and the determination reference voltage, and outputs a digital signal corresponding to the occurrence/non-occurrence of the contact between the contact section 41 and the medium M to the CPU 92. The voltage comparison section 54 determines the occurrence/non-occurrence of the contact between the contact section 41 and the medium M in a state in which influence of noise, which impedes the detection of the contact between the contact section 41 and the medium M, is small, and thus it is possible to exactly and stably determine the occurrence/non-occurrence of the contact between the contact section 41 and the medium M.

In a case where the CPU 92 receives the digital signal which indicates that the contact section 41 is in contact with the medium M, the CPU 92 stops operations of the transport section 20 and the printing section 30. After a user investigates a cause of the contact between the contact section 41 and the medium M and modifies the cause of the contact between the contact section 41 and the medium M, the user restarts the operations of the transport section 20 and the printing section 30 and restarts recording by the recording head 31 with respect to the medium M.

In the recording apparatus 10, the relative location between the contact section 41 and the medium M is changed in a state in which the movement velocity V2 of the contact section 41 is equal to or larger than the transport velocity V1 of the medium M, and, furthermore, the minute irregularities are provided on the surface of the contact section 41 which is in contact with the medium M, and thus it is possible to generate a large ultrasonic wave even in a case where the contact section 41 is slightly in contact with the medium M, compared to, for example, a case where the movement velocity V2 of the contact section 41 is slow or a case where the surface of the contact section 41 which is in contact with the medium M is smooth.

Since the large ultrasonic wave is generated in the case where the contact section 41 is in contact with the medium M, the detection device 40, which is mounted on the recording apparatus 10, is capable of exactly and stably detecting the occurrence/non-occurrence of the contact between the contact section 41 and the medium M by monitoring the state of the ultrasonic wave.

In the recording apparatus 10, the contact section 41 is disposed on the upstream with respect to the recording head 31 in the transport direction F, and thus the medium M is in contact with the contact section 41 earlier than the recording head 31. That is, the contact between the contact section 41 and the medium M occurs earlier than the contact between the recording head 31 and the medium M, and thus, in the recording apparatus 10, it is possible to grasp risk in which the recording head 31 is in contact with the medium M in advance in such a way that the detection device 40 detects the contact between the contact section 41 and the medium M.

Accordingly, in the recording apparatus 10, it is possible to grasp the risk in which the recording head 31 is in contact with the medium M in advance, and thus, before the recording head 31 is actually in contact with the medium M, it is possible to solve the cause that the recording head 31 is in contact with the medium M, to prevent the contact between the recording head 31 and the medium M in advance, and to prevent bad influence of the contact between the recording head 31 and the medium M (jamming of the medium M, failure in the recording head 31, or the like) in advance.

In the recording apparatus 10, the contact section 41 is disposed in the location which a gap with respect to the medium M is less than the distance H1 (at prescribed distance) and is disposed to be closer to the medium M than the recording head 31, and thus the detection device 40 which is mounted on the recording apparatus 10 is capable of detecting slight floating of the medium M which is not in contact with the recording head 31. The slight floating of the medium M which is not in contact with the recording head 31 is a sign of enormous floating of the medium M to be in contact with the recording head 31, and thus it is possible to detect the sing of the enormous floating of the medium M to be in contact with the recording head 31 using the ultrasonic wave which is generated due to the contact between the medium M and the contact section 41.

Furthermore, in the recording apparatus 10, the detection device 40 detects the sign (slight floating of the medium M) which causes the recording head 31 to be in contact with the medium M, and thus it is possible to conceive a countermeasure to improve the sign, that is, a preventive measure to prevent the recording head 31 from being in contact with the medium M.

Embodiment 2

Figure 5:
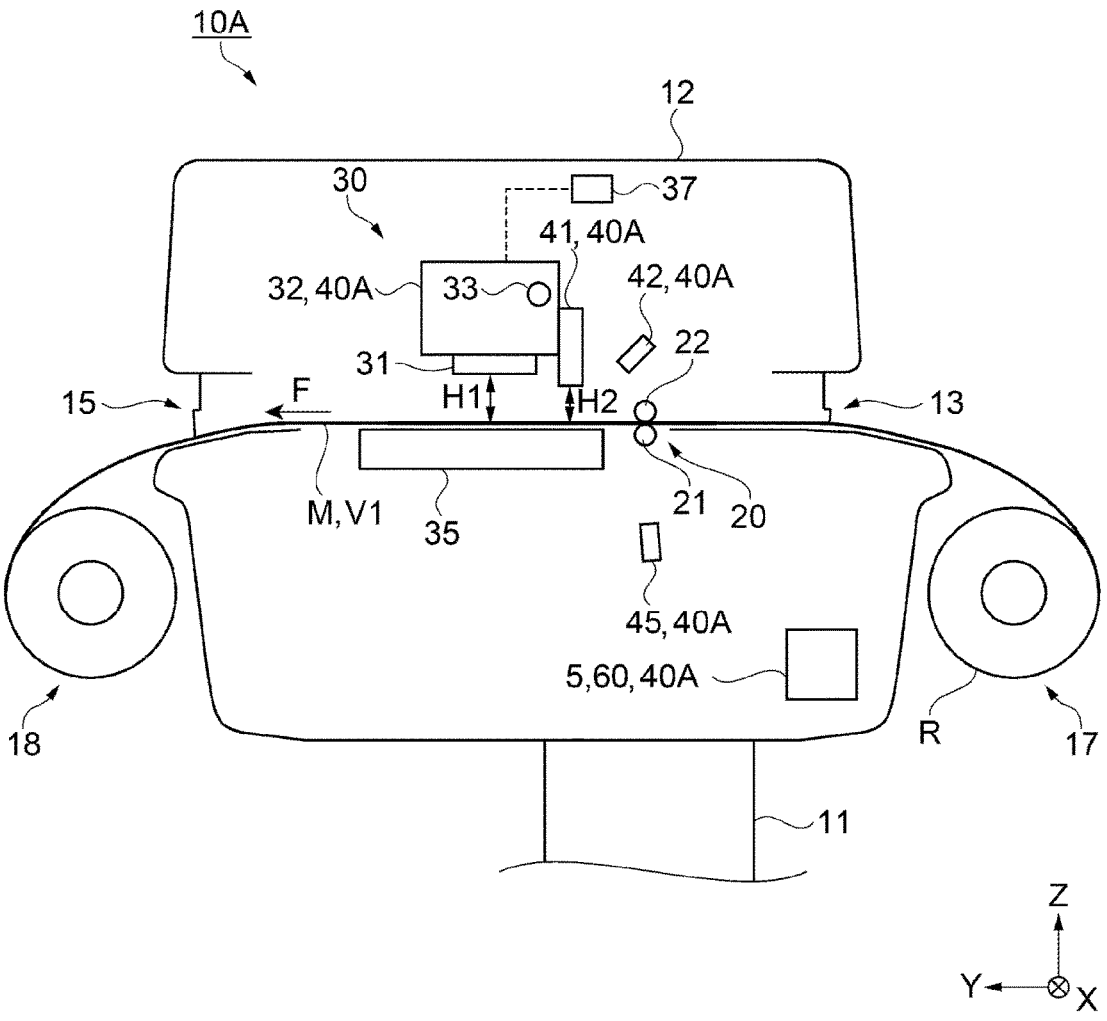
FIG. 5 is a schematic diagram of a recording apparatus according to Embodiment 2.
Figure 6:
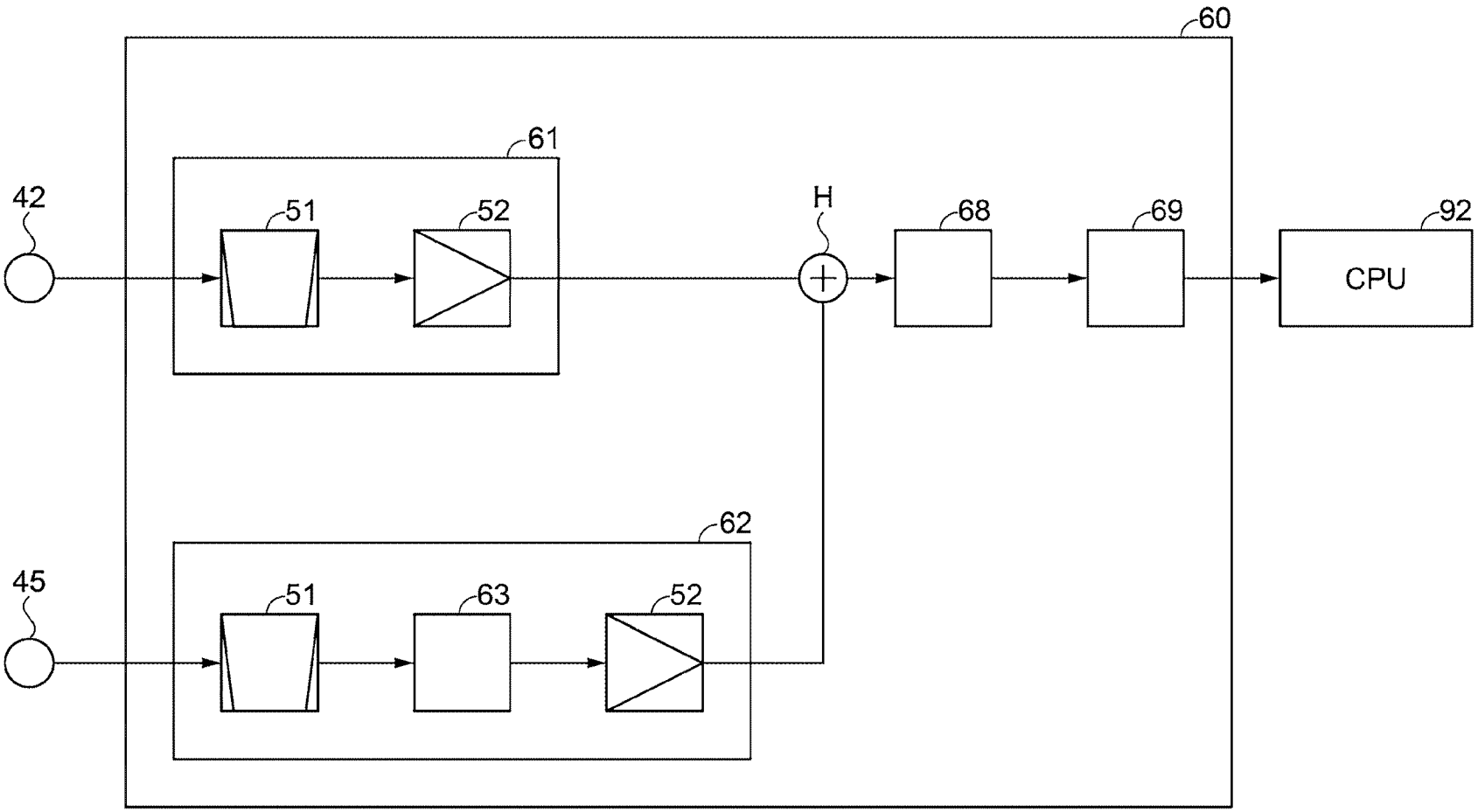
FIG. 6 is a block diagram illustrating an outline of a detection circuit.
Figure 7:
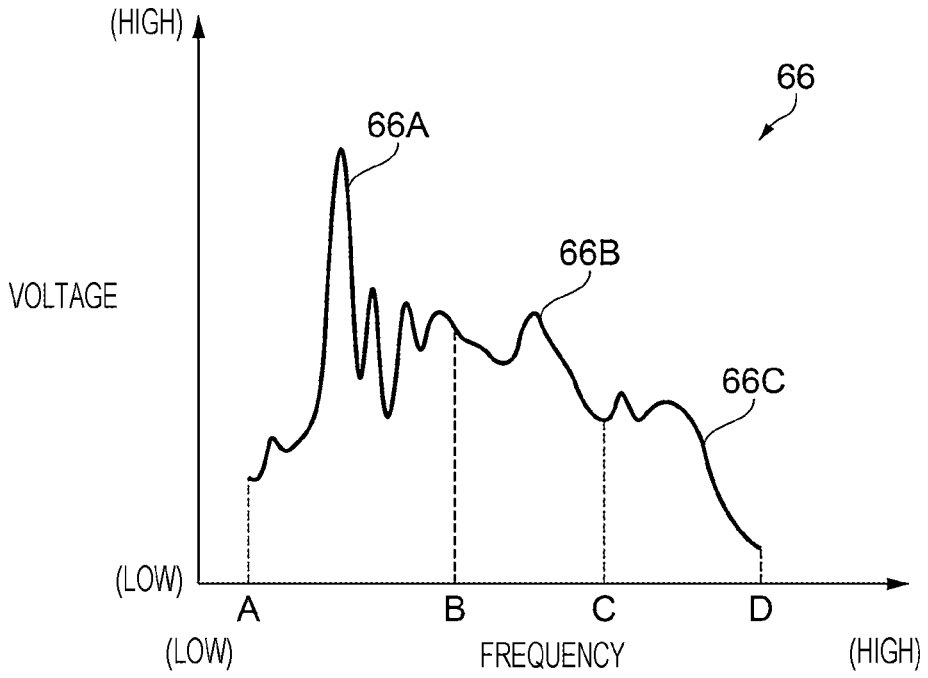
FIG. 7 is a schematic diagram of a second detection signal.
Figure 8:
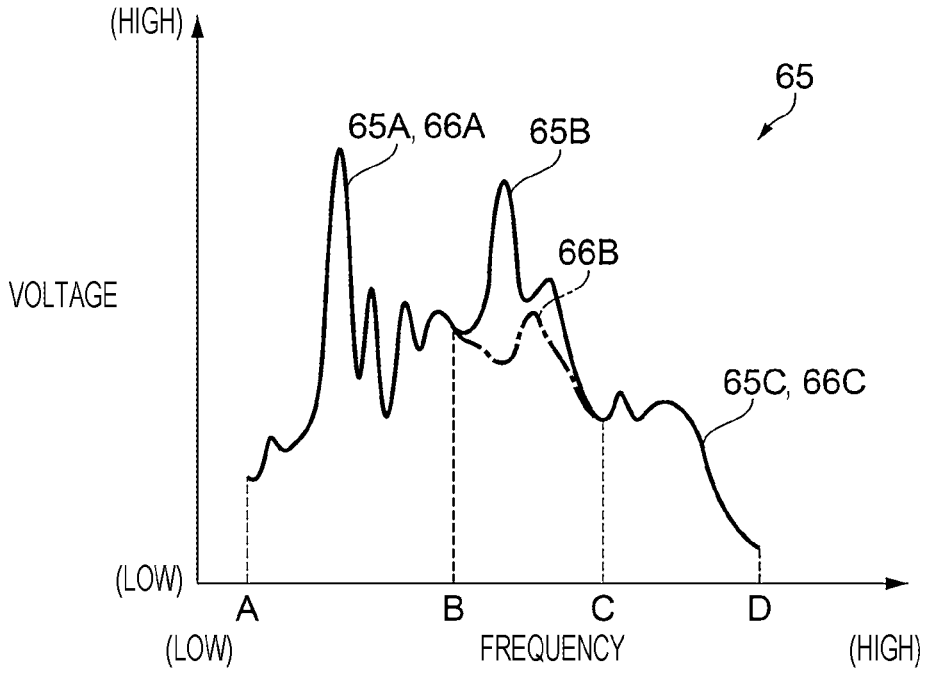
FIG. 8 is a schematic diagram of a first detection signal.

FIG. 5 is a diagram corresponding to FIG. 1 and is a schematic diagram of a recording apparatus according to Embodiment 2. FIG. 6 is a block diagram illustrating an outline of a detection circuit. FIG. 7 is a schematic diagram of a second detection signal. FIG. 8 is a schematic diagram of a first detection signal.

Meanwhile, in FIG. 8, a second detection signal 66 is illustrated using a dashed line.

Hereinafter, an outline of a detection device 40A which is mounted on a recording apparatus 10A according to the embodiment will be described based on difference from Embodiment 1 with reference to FIGS. 5 to 8. In addition, the same reference symbols are attached to components which are the same as in Embodiment 1, and description thereof will not be repeated.

As illustrated in FIG. 5, the detection device 40A which is mounted on the recording apparatus 10A according to the embodiment includes a contact section 41, a carriage 32, an ultrasonic sensor 42, a second ultrasonic sensor 45, and a detection circuit 60. That is, in the embodiment, the detection device 40A includes two ultrasonic sensors 42 and 45. This point is one of the differences between the embodiment and Embodiment 1. Although details will be described later, a configuration of the detection circuit 60 according to the embodiment is different from that of the detection circuit 50 according to Embodiment 1. This point is also one of the differences between the embodiment and Embodiment 1.

The ultrasonic sensor 42 is a sensor device which is capable of detecting an ultrasonic wave, and is disposed in a location where it is easy to detect the contact sound between the contact section 41 and the medium M. The ultrasonic sensor 42 is disposed on a Z (+) direction side with respect to the medium M.

The second ultrasonic sensor 45 is a sensor device which is capable of detecting the ultrasonic wave, and is disposed in a location where it is easy to detect the operation sound of the recording apparatus 10. The second ultrasonic sensor 45 is disposed on the Z (−) direction side with respect to the medium M.

The ultrasonic sensor 42 mainly detects the contact sound between the contact section 41 and the medium M, and second ultrasonic sensor 45 mainly detects the operation sound of the recording apparatus 10. In other words, the ultrasonic sensor 42 mainly detects sound in order to detect the contact between the medium M and the contact section 41, and the second ultrasonic sensor 45 mainly detects noise which impedes detection of the contact between the medium M and the contact section 41.

As illustrated in FIG. 6, the detection circuit 60 includes a first detection section 61, a second detection section 62, a RAM 68, and a Fast Fourier Transform (FFT) processing section 69.

The first detection section 61 includes a filter section 51 and an amplifying section 52. The filter section 51 extracts a necessary frequency component from an AC signal which is output from the ultrasonic sensor 42, removes an unnecessary frequency component, and outputs the AC signal to the amplifying section 52 as the first detection signal 65. The first detection signal 65 is amplified by the amplifying section 52.

The second detection section 62 includes a filter section 51, a phase inversion circuit 63, and an amplifying section 52. The filter section 51 extracts a necessary frequency component from an AC signal which is output from the second ultrasonic sensor 45, removes an unnecessary frequency component, and outputs the AC signal to the phase inversion circuit 63 as the second detection signal 66. The second detection signal 66 is amplified by the amplifying section 52 after a phase of the second detection signal 66 is inversed by the phase inversion circuit 63.

As illustrated in FIG. 7, the second detection signal 66 includes many signals resulting from noise (the operation sound of the recording apparatus 10) which impedes the detection of the contact between the medium M and the contact section 41, and includes a second detection signal 66A having frequencies A and B, a second detection signal 66B having frequencies B and C, and a second detection signal 66C having frequencies C and D.

As illustrated in FIG. 8, the first detection signal 65 includes a first detection signal 65A having frequencies A and B, a first detection signal 65B having frequencies B and C, and a first detection signal 65C having frequencies C and D. The first detection signal 65A includes a signal resulting from noise which impedes the detection of the contact between the medium M and the contact section 41, and a signal resulting from the contact sound between the contact section 41 and the medium M.

The first detection signal 65A having the frequencies A and B is a signal (noise) resulting from the operation sound of the recording apparatus 10, and corresponds to the second detection signal 66A having the frequencies A and B. The first detection signal 65C having the frequencies C and D is a signal (noise) resulting from the operation sound of the recording apparatus 10, and corresponds to the second detection signal 66C having the frequencies C and D.

The first detection signal 65B having the frequencies B and C includes a signal (noise) resulting from the operation sound of the recording apparatus 10, and the signal resulting from the contact sound between the contact section 41 and the medium M. The signal (noise) resulting from the operation sound of the recording apparatus 10 in the first detection signal 65B having the frequencies B and C is illustrated using a dashed line in the drawing, and corresponds to the second detection signal 66B having the frequencies B and C. Furthermore, the difference between the first detection signal 65B having the frequencies B and C illustrated using a solid line in the drawing and the signal (the second detection signal 66B of the frequencies B and C) resulting from the operation sound of the recording apparatus 10 in the first detection signal 65B having the frequencies B and C illustrated using a dashed line in the drawing is the signal resulting from the contact sound between the contact section 41 and the medium M in the first detection signal 65B having the frequencies B and C.

Returning to FIG. 6, the first detection signal 65 and the second detection signal 66, in which the phase is inversed, are synthesized at a confluence point H, a signal corresponding to the difference between the first detection signal 65 and the second detection signal 66, that is, the signal resulting from the contact sound between the contact section 41 and the medium M in the first detection signal 65B having the frequencies B and C is stored in the RAM 68 as the determination signal.

As described above, the determination signal, which is the difference between the first detection signal 65 and the second detection signal 66, is a signal in which noise (signal resulting from the operation sound of the recording apparatus 10) which impedes the detection of the contact between the medium M and the contact section 41 is cancelled and results from the contact between the medium M and the contact section 41.

In other words, the second detection section 62 is a noise canceller that acquires noise, which impedes the detection of the contact between the medium M and the contact section 41, in real time and cancels the noise in real time. Furthermore, the determination signal, in which the noise is cancelled in real time, is stored in the RAM 68.

Therefore, time-series data of the determination signal, which is stored in the RAM 68, has a small voltage fluctuation waveform in a case where the contact between the contact section 41 and the medium M is not generated, and has a large voltage fluctuation waveform in a case where the contact between the contact section 41 and the medium M is generated.

The FFT processing section 69 detects whether or not the contact between the medium M and the contact section 41 is generated based on the time-series data of the determination signal which is stored in the RAM 68. Specifically, in a case where the large voltage fluctuation, which is larger than a determination value, is generated in the time-series data of the determination signal, the FFT processing section 69 determines that the contact between the medium M and the contact section 41 is generated, and transmits a signal, which notifies that the contact between the medium M and the contact section 41 is generated, to the CPU 92.

In a case where the signal, which notifies that the contact between the medium M and the contact section 41 is generated, is received, the CPU 92 stops operations of the transport section 20 and the printing section 30. The user investigates the cause of the contact between the contact section 41 and the medium M, restarts the operations of the transport section 20 and the printing section 30 after modifying the cause of the contact between the contact section 41 and the medium M, and restarts recording performed by the recording head 31 with respect to the medium M.

The detection circuit 60 acquires the noise, which impedes the detection of the contact between the medium M and the contact section 41, in real time, and cancels the noise in real time. Therefore, compared to a configuration in which the noise is not acquired in real time (for example, detection circuit 50 according to Embodiment 1), it is possible to detect the contact between the medium M and the contact section 41 with higher accuracy.

Meanwhile, a configuration in which the determination signal is stored in the memory 93 of the control unit 5 without providing the RAM 68 in the detection circuit 60 may be provided.

Embodiment 3

FIGS. 9 to 12 are diagrams corresponding to FIG. 3, and are schematic diagrams illustrating an outline of a recording apparatus according to Embodiment 3.

Figure 9:
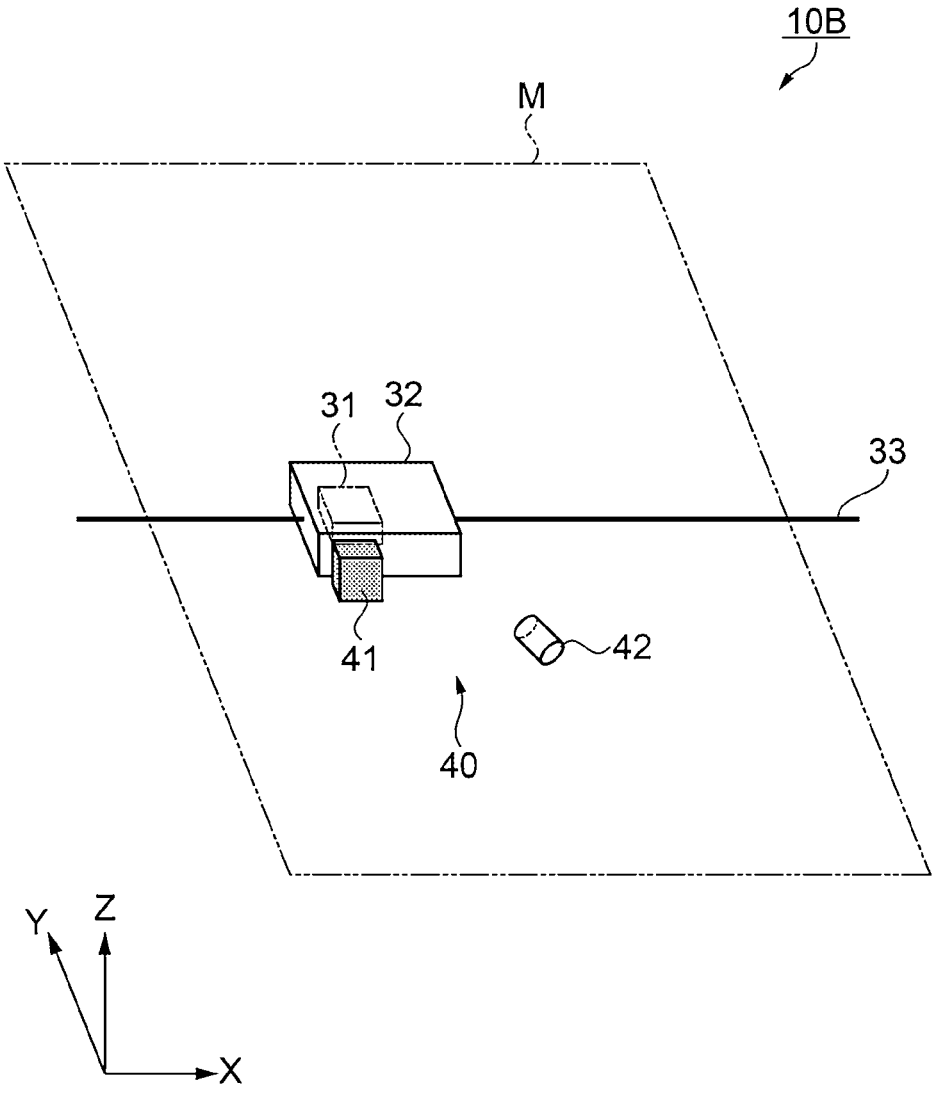
FIG. 9 is a schematic diagram illustrating an outline of a recording apparatus according to Embodiment 3.
Figure 10:
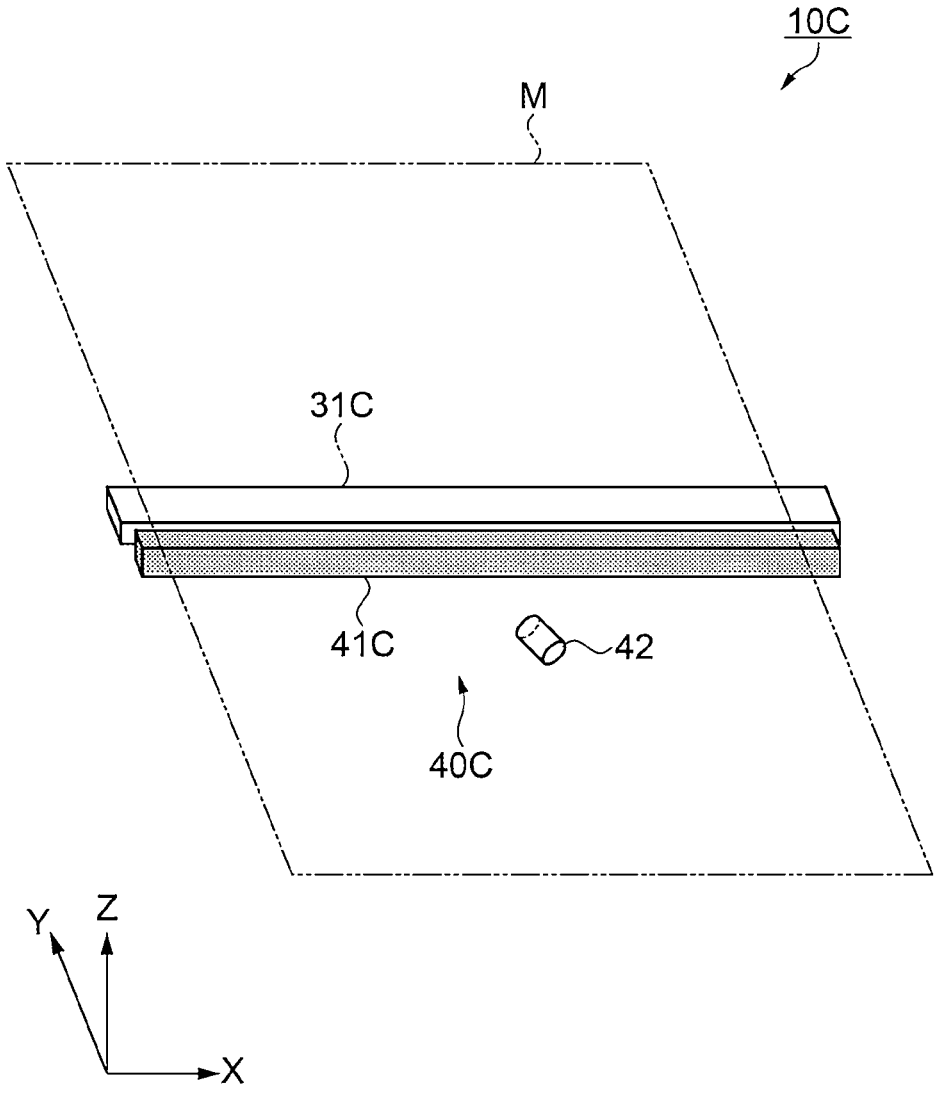
FIG. 10 is a schematic diagram illustrating an outline of another recording apparatus according to Embodiment 3.
Figure 11:
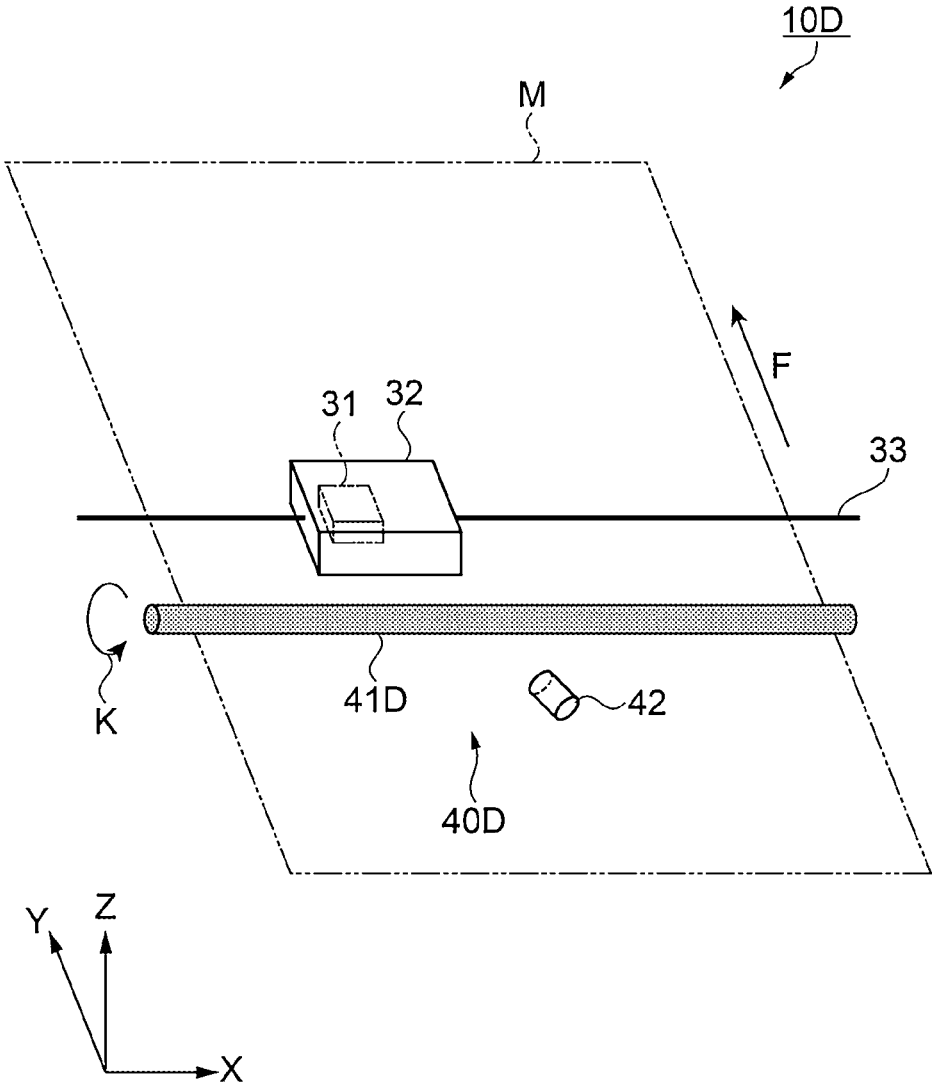
FIG. 11 is a schematic diagram illustrating an outline of another recording apparatus according to Embodiment 3.
Figure 12:
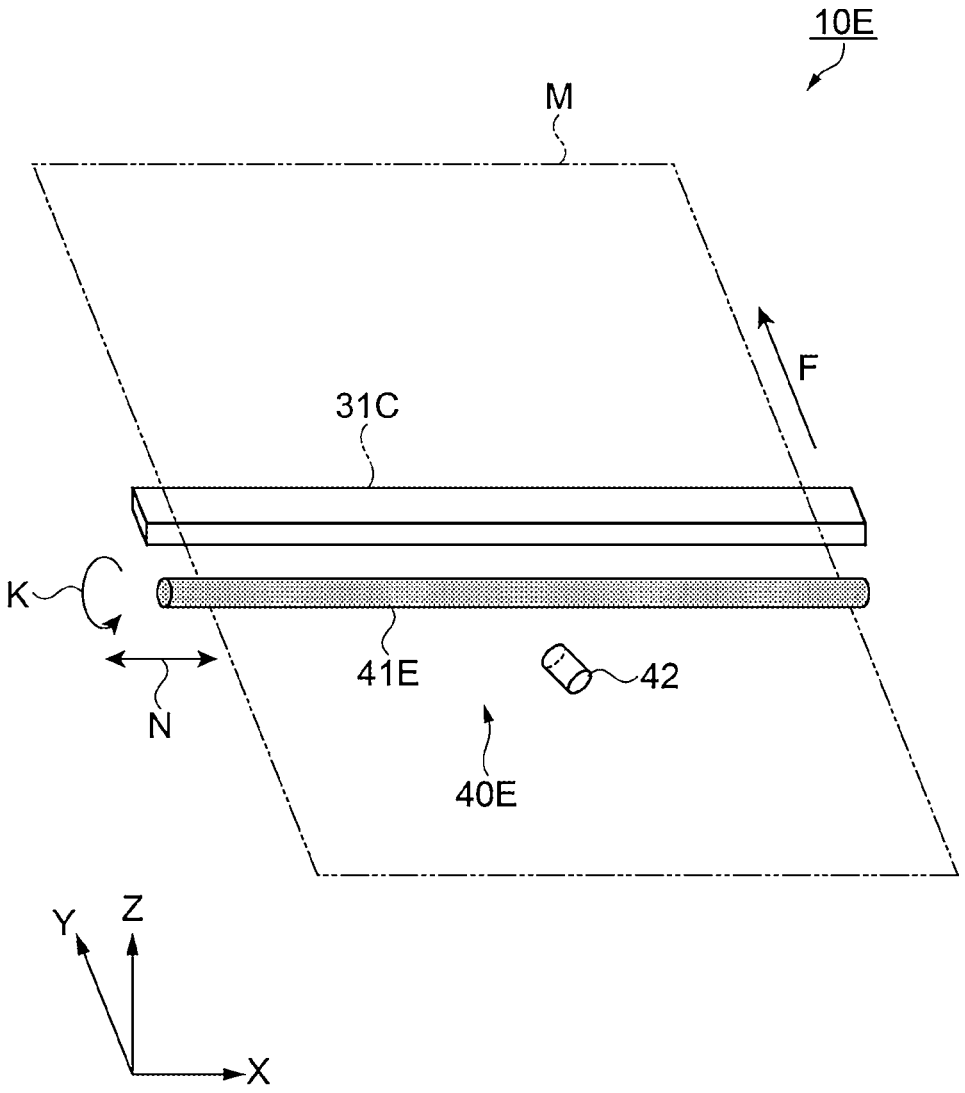
FIG. 12 is a schematic diagram illustrating an outline of another recording apparatus according to Embodiment 3.

Specifically, FIG. 9 is a schematic diagram illustrating an outline of a recording apparatus 10B according to the embodiment. FIG. 10 is a schematic diagram illustrating an outline of another recording apparatus 10C according to the embodiment. FIG. 11 is a schematic diagram illustrating an outline of another recording apparatus 10D according to the embodiment. FIG. 12 is a schematic diagram illustrating an outline of another recording apparatus 10E according to the embodiment.

Meanwhile, in FIGS. 9 to 12, components which are necessary for description are illustrated, and components which are not necessary for description are not illustrated. Furthermore, in FIGS. 9 to 12, the medium M is illustrated using a two-dot dashed line. Meanwhile, the same reference symbols are attached to components which are the same as in Embodiment 1, and description thereof will not be repeated.

Hereinafter, the outline of the recording apparatus according to the embodiment will be described with reference to FIGS. 9 to 12.

As illustrated in FIG. 9, the recording apparatus 10B includes a recording head 31 that performs recording with respect to the medium M at a prescribed distance (distance H1), a carriage 32 that supports the recording head 31, and a detection device 40.

The carriage 32 is supported by a guide shaft 33, and is capable of moving in the X direction (width direction of the medium M) by the movement mechanism 37 (see FIG. 1). Furthermore, the guide shaft 33 is capable of moving in the Y direction (length direction of the medium M) which crosses the X direction by the movement mechanism (not shown in the drawing). As a result, the recording head 31, which is supported by the carriage 32 and the carriage 32, is capable of moving in the X direction and the Y direction.

In the recording apparatus 10B, the medium M is stopped, and the recording head 31 is moved in the X direction and the Y direction, and thus recording is performed on the medium M. In the recording apparatus 10 according to Embodiment 1, the medium M is transported in the transport direction F and the recording head 31 is moved in the direction (X direction), which is orthogonal to the transport direction F, and thus recording is performed on the medium M. This point is one of the differences between the recording apparatus 10B according to the embodiment and the recording apparatus 10 according to Embodiment 1.

The carriage 32 is a component of the detection device 40, and is an example of a "location change section" in the detection device 40. The carriage 32 moves the contact section 41 to face the medium M, and changes a relative location between the medium M and the contact section 41. In the embodiment, the contact section 41 is supported by the carriage 32 and is moved in the X direction and the Y direction. In Embodiment 1, the contact section 41 is supported by the carriage 32 and is moved in the X direction. This point is also one of the differences between the embodiment and Embodiment 1.

In the recording apparatus 10B, the relative location between the medium M and the contact section 41 is changed, and thus a large ultrasonic wave is generated even in a case where the contact section 41 is slightly in contact with the medium M.

Furthermore, the detection device 40 is capable of monitoring the ultrasonic wave which is generated in the case where the contact section 41 is in contact with the medium M, and is capable of detecting risk in which the recording head 31 is in contact with the medium M and a sign (slight floating of the medium M) which causes the contact between the recording head 31 and with the medium M. Furthermore, in the recording apparatus 10B, the detection device 40 detects the risk and the sign, and thus it is possible to prevent bad influence due to the contact between the recording head 31 and the medium M in advance and it is possible to conceive a preventive measure to prevent the recording head 31 from being in contact with the medium M.

As illustrated in FIG. 10, the recording apparatus 10C includes a line head 31C, which is an example of a "recording section", and a detection device 40C.

The line head 31C is disposed at a prescribed distance with respect to the medium M, and is capable of moving in the Y direction. The line head 31C is disposed to face over the whole medium M in the direction (X direction) which crosses a direction (Y direction) in which the line head 31C moves. In the line head 31C, nozzles (not shown in the drawing) which discharge ink are provided to face over the whole medium M in the X direction.

The recording apparatus 10C is a recording apparatus using a line method in which recording is performed on the medium M in such a way that the medium M is stopped and the line head 31C discharges ink while moving in the Y direction. This point is one of the differences from the recording apparatus 10 according to Embodiment 1.

The detection device 40C includes a contact section 41C, an ultrasonic sensor 42, and a detection circuit 50 (see FIG. 4). The contact section 41C is disposed to face over the whole medium M in the direction (X direction) which crosses the direction (Y direction) in which the line head 31C moves. This point is one of the differences from the contact section 41 according to Embodiment 1.

The contact section 41C is supported by the line head 31C, and is capable of moving in the Y direction together with the line head 31C. The contact section 41C moves in the Y direction, and thus a relative location between the medium M and the contact section 41C is changed.

Meanwhile, the line head 31C is an example of a "location change section" which supports the contact section 41C and is capable of moving the contact section 41C in the Y direction, and is a part of components of the detection device 40C.

In the recording apparatus 10C, the relative location between the medium M and the contact section 41C is changed, and thus a large ultrasonic wave is generated even in a case where the contact section 41C is slightly in contact with the medium M.

Furthermore, the detection device 40C is capable of monitoring the ultrasonic wave which is generated in the case where the contact section 41C is in contact with the medium M, and is capable of detecting risk in which the line head 31C is in contact with the medium M and a sign (slight floating of the medium M) which causes contact between the line head 31C and the medium M. Furthermore, in the recording apparatus 10C, the detection device 40C detects the risk and the sign, and thus it is possible to prevent bad influence due to the contact between the line head 31C and the medium M, and, furthermore, it is possible to conceive a preventive measure to prevent the line head 31C from being in contact with the medium M.

Meanwhile, the recording apparatus 10C may be configured such that recording is performed on the medium M in such a way that the line head 31C is stopped and the medium M moves in the Y direction. That is, the recording apparatus 10C may be configured such that the relative location between the medium M and the contact section 41C is changed in such a way that the line head 31C supports the contact section 41C, the line head 31C and the contact section 41C are in a stop state, and the medium M is transported in the Y direction. In this case, a configuration in which the medium M is transported is an example of a "location change section" which changes the relative location between the medium M and the contact section 41, and is a part of the components of the detection device 40C.

As illustrated in FIG. 11, the recording apparatus 10D includes a recording head 31, which performs recording at a prescribed distance (distance H1) with respect to the medium M, and a detection device 40D.

The recording apparatus 10D is a recording apparatus using a serial method in which recording is performed on the medium M in such a way that the medium M is transported in the transport direction F and the recording head 31 moves in the direction (X direction), which is orthogonal to the transport direction F, and has a configuration which is the same as that of the recording apparatus 10 according to Embodiment 1.

The detection device 40D includes a contact section 41D which is capable of being in contact with the medium M, an ultrasonic sensor 42, and a detection circuit 50 (see FIG. 4).

The contact section 41D is a cylindrically formed stick which extends in the X direction which crosses the transport direction F. The contact section 41D is disposed on the upstream side with respect to the recording head 31 in the transport direction F to face over the whole medium M in the X direction which crosses the transport direction F. Furthermore, force in the transport direction F is given to the medium M by the transport section 20 (see FIG. 1), and the medium M is transported in the transport direction F.

The contact section 41D rotates in a direction (a counterclockwise direction viewed from a −X direction side of the contact section 41D) indicated by an arrow K in the drawing by a rotation mechanism (not shown in the drawing). That is, in a case where the contact section 41D is in contact with the medium M, the contact section 41D rotates such that force which resists force in the transport direction F is given to the medium M. In other words, the contact section 41D rotates a surface, which faces the medium M, in a direction which is opposite to the transport direction F, thereby increasing a velocity in which the surface, which faces the medium M, relatively moves together with the medium M.

In the recording apparatus 10D, the medium M is transported in the transport direction F, and thus the relative location between the medium M and the contact section 41D is changed. In addition, the contact section 41D rotates in the direction which is opposite to the transport direction F, and thus the relative location between the medium M and the contact section 41D is changed. Furthermore, an operation in which the transport section 20 transports the medium M in the transport direction F and an operation in which the contact section 41D rotates respectively become operations in which the relative location between the medium M and the contact section 41D is changed.

That is, a configuration in which the medium M is transported is an example of a "location change section" which changes the relative location between the medium M and the contact section 41D. In addition, in a case where the contact section 41D rotates, the relative location between the medium M and the contact section 41D is changed, and thus the contact section 41D serves as a "location change section" which changes the relative location between the medium M and the contact section 41D. That is, the contact section 41D serves as a "location change section" which rotates the contact section in a direction which is opposite to the transport direction.

Figure 13:
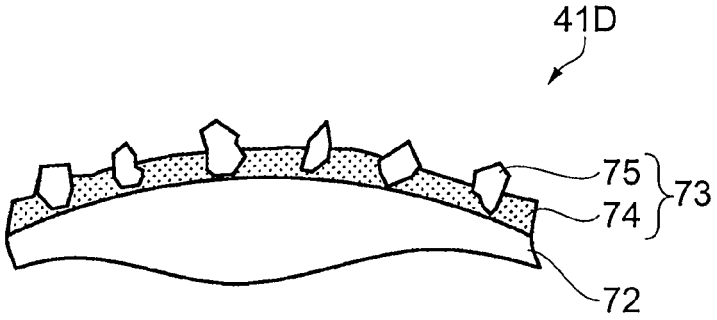
FIG. 13 is a schematic diagram illustrating a state of a cross section of a preferable contact section.
Figure 14:
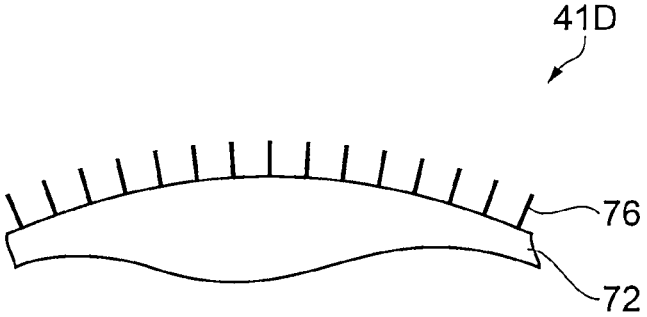
FIG. 14 is a schematic diagram illustrating the state of the cross section of the preferable contact section.

FIGS. 13 and 14 are schematic diagrams illustrating states of a cross section of a preferable contact section. That is, FIGS. 13 and 14 are diagrams illustrating an example of the preferable contact section 41D.

For example, it is preferable that the contact section 41D have a configuration in which minute irregularities are provided on a surface. Specifically, as illustrated in FIG. 13, the contact section 41D includes a roller section 72 and a rough surface section 73 which covers the roller section 72, and the rough surface section 73 is in contact with the medium M. The rough surface section 73 includes a bonding agent layer 74 which covers the roller section 72, and particles 75 which are embedded such that the particles protrude from the surface of the bonding agent layer 74. That is, in the contact section 41D, the minute irregularities are provided on the surface due to the particles 75.

For example, a configuration is preferable that the contact section 41D be a brush. Specifically, as illustrated in FIG. 14, the contact section 41D has a configuration in which hairs 76 are embedded in the surface of the roller section 72. It is preferable that the hairs 76 have flexibility and elasticity and be formed of a material which does not injure the medium M in a case where the hairs are in contact with the medium M.

Meanwhile, it is possible to use the contact section, in which the particles 75 and hairs 76 are embedded, in another embodiment in addition to Embodiment 3.

In a case of the configuration in which the minute irregularities are provided on a surface of the contact section 41D or the configuration in which the hairs 76 are embedded in the surface of the contact section 41D, it is possible to generate a larger large ultrasonic wave in the case where the contact section 41D is in contact with the medium M, compared to a case where the surface of the contact section 41D is smooth.

Furthermore, the detection device 40D is capable of monitoring the ultrasonic wave which is generated in the case where the contact section 41D is in contact with the medium M, and is capable of highly sensitively and certainly detecting the risk in which the recording head 31 is in contact with the medium M and the sign (slight floating of the medium M) which causes contact between the recording head 31 and the medium M. Furthermore, in the recording apparatus 10D, the detection device 40D detects the risk and the sign, and thus it is possible to prevent bad influence due to the contact between the recording head 31 and the medium M in advance and it is possible to conceive a preventive measure to prevent the recording head 31 from being in contact with the medium M.

Meanwhile, in the recording apparatus 10D, the contact section 41 may be added to the carriage 32. That is, the recording apparatus 10D may have a configuration provided with two contact sections 41 and 41D including the contact section 41 that is supported by the carriage 32 and the contact section 41D that rotates such that force, which resists force in the transport direction F, is given to the medium M in a case where the contact section 41D is in contact with the medium M. In the case of the two contact sections 41 and 41D, it is possible to generate a larger ultrasonic wave in a case where the contact sections 41 and 41D are in contact with the medium M, compared to a case of one contact section 41D.

As illustrated in FIG. 12, the recording apparatus 10E includes a line head 31C, which is an example of a "recording section", and a detection device 40E.

The recording apparatus 10E is a recording apparatus using a line method in which recording is performed on the medium in such a way that the medium M is transported in the transport direction F and ink is discharged in a state in which the line head 31C is stopped, and has the same configuration as the above-described recording apparatus 10C.

The detection device 40E includes a contact section 41E, an ultrasonic sensor 42, and the like. The contact section 41E is a cylindrically formed stick which extends in the X direction which crosses the transport direction F. The contact section 41E is disposed on the upstream side with respect to the line head 31C in the transport direction F to face over the whole medium M in the X direction which crosses the transport direction F. Furthermore, although not shown in the drawing, the contact section 41E includes minute irregularities (see FIG. 13) on the surface as the same as the above-described contact section 41D.

In a case where the contact section 41E is in contact with the medium M, the contact section 41E rotates in a direction (counterclockwise direction) which is indicated by an arrow K in the drawing such that force which resists force in the transport direction F is given to the medium M. Furthermore, the contact section 41E slides in a direction (direction which is different from the transport direction F) which is indicated by an arrow N in the drawing by a movement mechanism (not shown in the drawing). This point is one of the differences from the contact section 41D in the above-described recording apparatus 10D.

As described above, the detection device 40E includes an operation in which the contact section 41E rotates, and an operation in which the contact section 41E slides. In a case where the contact section 41E is in contact with the medium M in a state of including the operation in which the contact section 41E rotates and the operation in which the contact section 41E slides, it is possible to generate a large ultrasonic wave even in a case where the contact section 41E is slightly in contact with the medium M, compared to a case where the detection device 40E includes any one of the operations in which the contact section 41E rotates and in which the contact section 41E slides.

Furthermore, the detection device 40E is capable of monitoring the ultrasonic wave which is generated in the case where the contact section 41E is in contact with the medium M, and is capable of highly sensitively and certainly detecting the risk in which the line head 31C is in contact with the medium M and the sign (slight floating of the medium M) which causes contact between the line head 31C and the medium M. Furthermore, in the recording apparatus 10E, the detection device 40E detects the risk and the sign, and thus it is possible to prevent bad influence due to the contact between the line head 31C and the medium M in advance and it is possible to conceive a preventive measure to prevent the line head 31C from being in contact with the medium M.

Meanwhile, the recording apparatus 10E may have a configuration which includes any one of the operations in which the contact section 41E rotates and in which the contact section 41E slides.

Furthermore, although the detection devices 40, 40C, 40D, and 40E detect the contact between the contact sections 41, 41C, 41D, and 41E and the medium M using the detection circuit 50 (see FIG. 4), a configuration may be provided in which detection devices 40, 40C, 40D, and 40E detect the contact between the contact sections 41, 41C, 41D, and 41E and the medium M using the detection circuit 60 (see FIG. 6).

Embodiment 4

Figure 15:
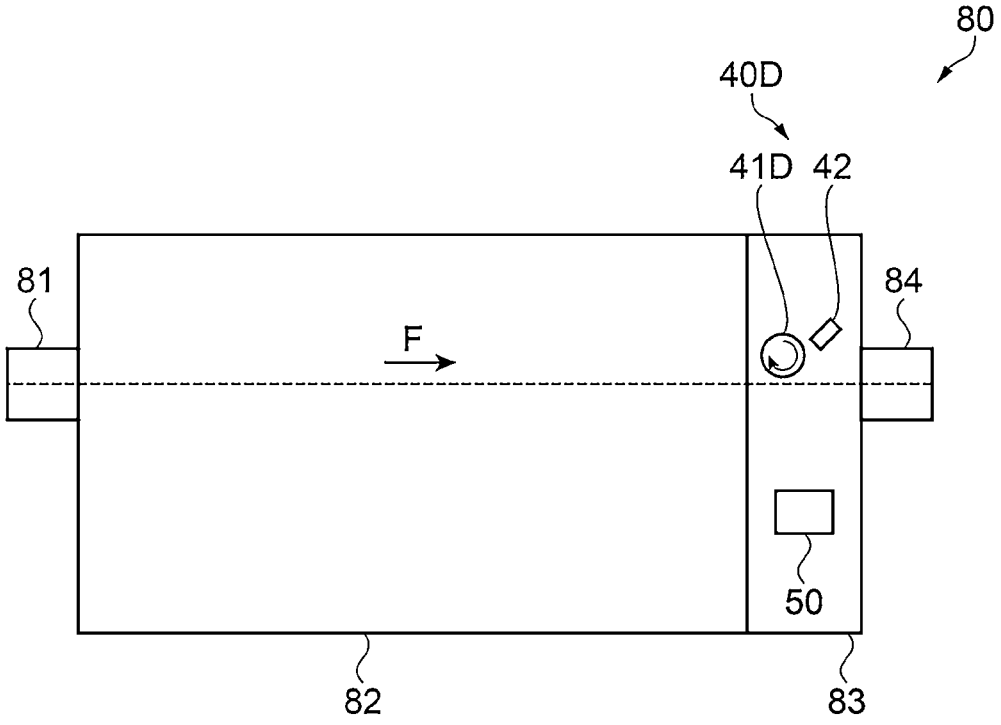
FIG. 15 is a schematic diagram illustrating an outline of a paper recycling apparatus according to Embodiment 4.

FIG. 15 is a schematic diagram illustrating an outline of a paper recycling apparatus according to Embodiment 4.

As illustrated in FIG. 15, a paper recycling apparatus 80 according to Embodiment 4 includes a setting section 81, a reproduction unit 82, an inspection unit 83, and a loading section 84.

For example, used waste paper is set in the setting section 81, and is supplied from the setting section 81 to a middle of the reproduction unit 82. In the reproduction unit 82, the waste paper which is supplied from the setting section 81 is crushed to be a fibrous state, and then is reproduced as recycled paper which can be newly printed. Existence/non-existence of wrinkles and creases of the recycled paper, which is reproduced by the reproduction unit 82, is inspected by the inspection unit 83, and recycled paper which has not wrinkles, creases, or the like and is capable of being newly printed is loaded into the loading section 84.

That is, in the paper recycling apparatus 80, the used waste paper is transported through a transport path, which is indicated by a broken line in the drawing, in the transport direction F, and is reproduced as the recycled paper which can be newly printed.

In the inspection unit 83, the detection device 40D is disposed which includes the contact section 41D, the ultrasonic sensor 42, and the detection circuit 50. The contact section 41D is a cylindrically formed stick which extends in the direction which crosses the transport direction F. The contact section 41D is disposed to face over the whole recycled paper in the direction which crosses the transport direction F. The contact section 41D rotates in a direction (clockwise direction), which is indicated by an arrow in the drawing, by the rotation mechanism (not shown in the drawing). In a case where the contact section 41D is in contact with the recycled paper, the contact section 41D rotates such that force which resists force in the transport direction F is given with respect to the recycled paper.

Furthermore, in cases where the recycled paper is modified by wrinkles, creases, or the like, change is generated in a thickness direction of the recycled paper, and the recycled paper is in contact with the contact section 41D, contact sound (ultrasonic wave) between the recycled paper and the contact section 41D is generated, and the detection device 40D detects existence/non-existence of the wrinkles or creases of the recycled paper from the contact sound (ultrasonic wave) between the recycled paper and the contact section 41D.

The recycled paper, which is determined that there is no wrinkle or crease by the detection device 40D, is determined to be a good item which can be newly printed, is loaded into the loading section 84.

The recycled paper, which is determined that there are wrinkles or creases by the detection device 40D, is determined to be an inferior item that is difficult to be newly printed, is returned to the setting section 81, and is reproduced again by the reproduction unit 82. In addition, the recycled paper, which is determined to be the inferior item, may be used for another purpose in addition to printing.

As described above, in a case where the detection device 40D is mounted on the paper recycling apparatus 80, it is possible to monitor a state of the recycled paper, and to load only the recycled paper of the good item which can be newly printed and on the loading section 84. In addition, in a case where a large number of recycled papers which is determined to be the inferior item that is difficult to be newly printed, it is possible to perform maintenance on the reproduction unit 82 and to maintain and manage the reproduction unit 82 in a proper state.

Meanwhile, the inspection unit 83 may have a configuration in which the detection devices 40, 40A, 40C, and 40E are disposed instead of the detection device 40D and the state of the recycled paper is monitored by the detection devices 40, 40A, 40C, and 40E.

The invention is not limited to the above-described embodiments and may be appropriately changed in a range which does not depart from the gist or sprit of the invention which is read from the claims and the whole specification. Various modification examples are conceivable in addition to the above-described embodiments. Hereinafter, modification examples will be described.

Modification Example 1

Figure 16:
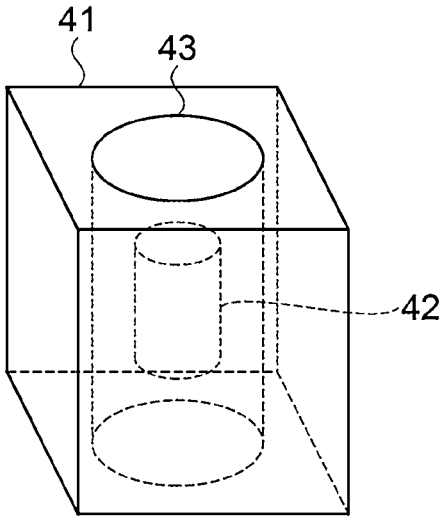
FIG. 16 is a schematic diagram illustrating a state of an ultrasonic sensor according to Modification Example 1.

FIG. 16 is a schematic diagram illustrating a state of an ultrasonic sensor according to Modification Example 1.

As illustrated in FIG. 16, an ultrasonic sensor 42 according to the Modification Example is stored in the inside of the contact section 41. That is, a cavity 43 is provided in the inside of the contact section 41, and the ultrasonic sensor 42 is disposed (stored) in a middle of the cavity 43 of the contact section 41.

In a case where the ultrasonic sensor 42 is disposed in a middle of the cavity 43 of the contact section 41, the ultrasonic sensor 42 is disposed to be close to a part where the medium M is in contact with the contact section 41, compared to a case where, for example, the ultrasonic sensor 42 is disposed on the outside of the contact section 41 (see FIG. 1) as in above-described Embodiment 1. Therefore, it is possible to reduce influence of noise which impedes the detection of the contact between the medium M and the contact section 41.

Modification Example 2

Figure 17:
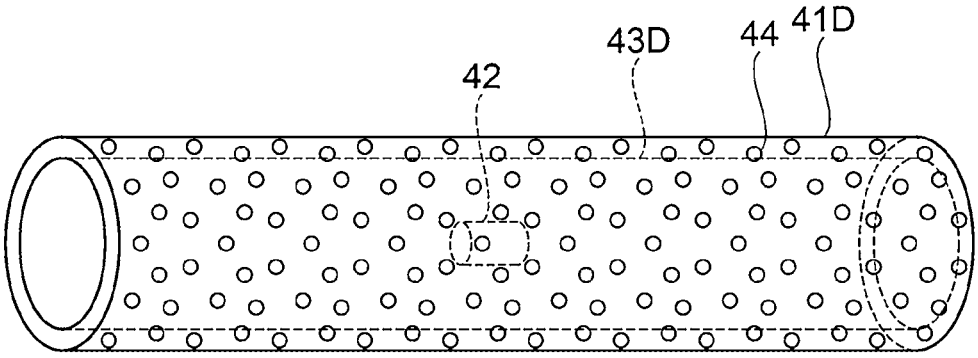
FIG. 17 is a schematic diagram illustrating a state of an ultrasonic sensor according to Modification Example 2.

FIG. 17 is a schematic diagram illustrating a state of the ultrasonic sensor according to Modification Example 2.

As illustrated in FIG. 17, the ultrasonic sensor 42 according to the Modification Example is stored in the inside of the contact section 41D. That is, a cavity 43D is provided in the inside of the contact section 41D, and the ultrasonic sensor 42 is disposed (stored) in the cavity 43D of the contact section 41D.

In a case where the ultrasonic sensor 42 is disposed in the inside of the cavity 43D of the contact section 41D, it is possible to dispose the ultrasonic sensor 42 to be close to a part where the medium M is in contact with the contact section 41D and it is possible to reduce the influence of noise which impedes the detection of the contact between the medium M and the contact section 41D, compared to, for example, a case where the ultrasonic sensor 42 is disposed on the outside of the contact section 41D (see FIG. 11) as in above-described Embodiment 3.

Furthermore, in the Modification Example, openings 44 which lead to the cavity 43D are provided on the surface of the contact section 41D. In a case where the openings 44 which lead to the cavity 43D are provided on the surface of the contact section 41D, the contact sound between the medium M and the contact section 41D effectively reaches the inside of the cavity 43D compared to a case where the openings 44 are not provided, and thus the ultrasonic sensor 42 is capable of highly sensitively detecting the contact sound between the medium M and the contact section 41D.

Modification Example 3

An electronic device, on which the detection device 40, 40A, 40C, 40D, or 40E is mounted, is not limited to the above-described recording apparatus 10, 10A, 10B, 10C, 10D, or 10E, or the paper recycling apparatus 80.

For example, the detection device 40, 40A, 40C, 40D, or 40E may be mounted on a post-processing device which performs a post process, such as a punching process or a staple processing, with respect to the medium on which the image is recorded. For example, the detection device 40, 40A, 40C, 40D, or 40E may be mounted on a transport device which is disposed between a print device which records an image and the post-processing device which performs the post process with respect to the medium on which the image is recorded.

That is, it is possible to mount the detection device 40, 40A, 40C, 40D, or 40E on the whole electronic device in which the medium is transported inside. In a case where the detection device 40, 40A, 40C, 40D, or 40E is mounted, it is possible to detect defects, such as floating, wrinkles, or creases, of the medium. The electronic device, on which the detection device 40, 40A, 40C, 40D, or 40E is mounted, is capable of selecting a medium, in which the defects are generated, as an inferior item. Furthermore, in a case where the defects of the medium are frequently generated, it is possible to perform repair or maintenance and it is possible to normally maintain the electronic device in a proper state.

Modification Example 4

The medium M may be a three-dimensional object which is three-dimensionally formed to have, for example, a curved surface, an irregular surface, or the like. In a case where a location is grasped based on shape data of the three-dimensional object, such as a time of formation, and printing is performed on the surface of the three-dimensional object, there is a case where deformation of the three-dimensional object is generated due to bending or the like. Therefore, there is a possibility that the recording head 31 and the line head 31C are in contact with the medium M, which is the three-dimensional object, while the recording head 31 and the line head 31C do not maintain a proper distance due to the difference between the shape data of the three-dimensional object and an actual shape of the three-dimensional object. Even in the case, it is possible to prevent the defects from being generated in advance using the detection device 40, 40A, 40C, 40D, or 40E as described above by applying the detection device 40, 40A, 40C, 40D, or 40E to a configuration in accordance with the three-dimensional object.

This application claims priority under 35 U.S.C. § 119 to Japanese Patent Application No. 2016-168966, filed Aug. 31, 2016. The entire disclosure of Japanese Patent Application No. 2016-168966 is hereby incorporated herein by reference.

What is claimed is:

1. A detection device that is capable of detecting a state of a medium, the device comprising:

a contact section that is capable of being in contact with the medium;

a location change section that changes a relative location between the medium and the contact section; and an ultrasonic sound wave sensing section that is capable of sensing an ultrasonic sound wave which is generated in a case where the medium is in contact with the contact section, wherein the location change section changes the relative location such that a relative velocity between the medium and the contact section is equal to or larger than a prescribed value, the location change section comprising a carriage configured to move the contact section in a direction different from a transport direction of the medium, and wherein the ultrasonic sound wave sensing section is capable of detecting the state of the medium by sensing the ultrasonic sound wave.

2. The detection device according to claim 1, wherein the ultrasonic sound wave sensing section comprises a first detector configured to detect sound generated when the medium is in contact with the contact section, a second detector to detect operation sound, and a circuit configured to obtain a determination signal from the first detector and the second detector in which operation sound is canceled, said determination signal indicating the state of the medium.

3. A recording apparatus comprising:

a recording section that performs recording on a medium at a prescribed distance;

a contact section that is capable of being in contact with the medium;

a location change section that changes a relative location between the medium and the contact section; and an ultrasonic sound wave sensing section that is capable of sensing an ultrasonic sound wave which is generated in a case where the medium is in contact with the contact section, wherein the location change section changes the relative location such that a relative velocity between the medium and the contact section is equal to or larger than a prescribed value, the location change section comprising a carriage configured to move the contact section in a direction different from a transport direction of the medium, and wherein the ultrasonic sound wave sensing section is capable of detecting the state of the medium by sensing the ultrasonic sound wave.

4. The recording apparatus according to claim 3, wherein the contact section is disposed in a location which is less than the prescribed distance with respect to the medium.

5. The recording apparatus according to claim 3, wherein the location change section is capable of moving the contact section to face the medium.

6. The recording apparatus according to claim 3, wherein the recording section is disposed to face over the whole medium in a direction that crosses a direction in which the location change section moves the contact section.

7. The recording apparatus according to claim 3, further comprising:

a transport section that transports the medium in a transport direction, wherein the prescribed value of the relative velocity is a transport velocity of the medium.

8. The recording apparatus according to claim 7, wherein the contact section is disposed on an upstream side rather than the recording section in the transport direction, and is capable of changing a location in a direction which is different from the transport direction by the location change section.

9. The recording apparatus according to claim 8, wherein the location change section rotates the contact section in a direction which is opposite to the transport direction.

10. The recording apparatus according to claim 7, wherein the recording section is disposed to face over the whole medium in a direction which crosses the transport direction.

11. The recording apparatus according to claim 3, wherein the ultrasonic sound wave sensing section comprises a first detector configured to detect sound generated when the medium is in contact with the contact section, a second detector to detect operation sound, and a circuit configured to obtain a determination signal from the first detector and the second detector in which operation sound is canceled, said determination signal indicating the state of the medium.

12. A recording apparatus comprising:

a recording section that performs recording on a medium at a prescribed distance;

a contact section that is capable of being in contact with the medium;

a transport section that transports the medium in a transport direction;

a location change section that changes a relative location between the medium and the contact section; and an ultrasonic wave sensing section that is capable of sensing an ultrasonic wave which is generated in a case where the medium is in contact with the contact section, wherein the location change section changes the relative location such that a relative velocity between the medium and the contact section is equal to or larger than the transport velocity of the medium, wherein the ultrasonic wave sensing section is capable of detecting the state of the medium by sensing the ultrasonic wave, wherein the location change section includes the recording section and the contact section which are mounted thereon, and is capable of moving to face the medium in a direction which crosses the transport direction.

13. The recording apparatus according to claim 12, wherein the ultrasonic sound wave sensing section comprises a first detector configured to detect sound generated when the medium is in contact with the contact section, a second detector to detect operation sound, and a circuit configured to obtain a determination signal from the first detector and the second detector in which operation sound is canceled, said determination signal indicating the state of the medium.

* * * * *